US009607610B2

(12) United States Patent
Agiomyrgiannakis

(10) Patent No.: US 9,607,610 B2
(45) Date of Patent: Mar. 28, 2017

(54) DEVICES AND METHODS FOR NOISE MODULATION IN A UNIVERSAL VOCODER SYNTHESIZER

(71) Applicant: Google Inc., Mountain View, CA (US)

(72) Inventor: Ioannis Agiomyrgiannakis, London (GB)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/632,890

(22) Filed: Feb. 26, 2015

(65) Prior Publication Data

US 2016/0005392 A1 Jan. 7, 2016

Related U.S. Application Data

(60) Provisional application No. 62/020,754, filed on Jul. 3, 2014.

(51) Int. Cl.

| | |
|---|---|
| ***G10L 13/033*** | (2013.01) |
| ***G10L 25/75*** | (2013.01) |
| ***G10L 13/027*** | (2013.01) |
| ***G10L 19/08*** | (2013.01) |
| ***G10L 19/16*** | (2013.01) |
| *G10L 19/02* | (2013.01) |

(52) U.S. Cl.

CPC ..... *G10L 13/027* (2013.01); *G10L 19/08* (2013.01); *G10L 19/16* (2013.01); *G10L 13/033* (2013.01); *G10L 19/02* (2013.01); *G10L 25/75* (2013.01)

(58) Field of Classification Search

CPC ..... G10L 13/027; G10L 13/08; G10L 25/75; G10L 25/93; G10L 13/033

USPC ..... 704/258, 260, 261, 268

See application file for complete search history.

(56) References Cited

U.S. PATENT DOCUMENTS

| | | | | |
|---|---|---|---|---|
| 4,852,168 A * | 7/1989 | Sprague | ..... | G10L 13/07 341/59 |
| 5,517,595 A | 5/1996 | Kleijn | | |
| 5,748,838 A * | 5/1998 | Stevens | ..... | G10L 13/04 704/261 |

(Continued)

FOREIGN PATENT DOCUMENTS

| | | | | |
|---|---|---|---|---|
| BE | EP 2242045 A1 * | 10/2010 | ..... | G10L 13/04 |
| EP | 2215632 B1 | 3/2011 | | |

OTHER PUBLICATIONS

Cabral, et al. "Towards a better representation of the envelope modulation of aspiration noise." Advances in Nonlinear Speech Processing. Springer Berlin Heidelberg, Jun. 2013, pp. 67-74.*

(Continued)

*Primary Examiner* — James Wozniak

(74) *Attorney, Agent, or Firm* — McDonnell Boehnen Hulbert & Berghoff LLP

(57) ABSTRACT

A device may receive an input indicative of acoustic feature parameters associated with speech. The device may determine a modulated noise representation for noise pertaining to one or more of an aspirate or a fricative in the speech based on the acoustic feature parameters. The aspirate may be associated with a characteristic of an exhalation of at least a threshold amount of breath. The fricative may be associated with a characteristic of airflow between two or more vocal tract articulators. The device may also provide an audio signal indicative of a synthetic audio pronunciation of the speech based on the modulated noise representation.

18 Claims, 10 Drawing Sheets

(56) References Cited

U.S. PATENT DOCUMENTS

| | | | | |
|---|---|---|---|---|
| 7,269,561 | B2 | 9/2007 | Mukhtar et al. | |
| 7,991,616 | B2 | 8/2011 | Fujita et al. | |
| 2001/0021905 | A1* | 9/2001 | Burnett | A61B 5/0507 704/233 |
| 2002/0029145 | A1* | 3/2002 | Miranda | G10L 13/04 704/258 |
| 2005/0131680 | A1* | 6/2005 | Chazan | G10L 19/02 704/205 |
| 2006/0004569 | A1* | 1/2006 | Yoshioka | G10L 13/033 704/225 |
| 2011/0166861 | A1 | 7/2011 | Wang et al. | |
| 2012/0053933 | A1* | 3/2012 | Tamura | G10L 13/04 704/207 |
| 2014/0088958 | A1* | 3/2014 | Chen | G10L 13/08 704/214 |
| 2015/0154980 | A1* | 6/2015 | Khan | G10L 25/66 704/203 |

OTHER PUBLICATIONS

Cabral, Joao P. "HMM-based speech synthesis using an acoustic glottal source model." 2011, pp. 1-350.*

D'Alessandro, Christophe, et al. "The speech conductor: gestural control of speech synthesis." Proceedings of the eNTERFACE, Aug. 2008, pp. 1-10.*

Drugman, et al. "Excitation modeling for HMM-based speech synthesis: Breaking down the impact of periodic and aperiodic components." Acoustics, Speech and Signal Processing (ICASSP), 2014 IEEE International Conference on. IEEE, May 2014, pp. 260-264.*

Erro, Daniel, et al. "HNM-based MFCC+ F0 extractor applied to statistical speech synthesis." Acoustics, Speech and Signal Processing (ICASSP), 2011 IEEE International Conference on. IEEE, May 2011, pp. 4728-4731.*

Erro, Daniel, et al. "MFCC+ F0 extraction and waveform reconstruction using HNM: preliminary results in an HMM-based synthesizer." Proc. FALA, Nov. 2010, pp. 29-32.*

Erro, Daniel, et al. "Harmonics plus noise model based vocoder for statistical parametric speech synthesis." Selected Topics in Signal Processing, IEEE Journal of 8.2, Mar. 2014, pp. 184-194.*

Grau, et al. "A speech formant synthesizer based on harmonic+ random formant-waveforms representations." EUROSPEECH. Sep. 1993, pp. 1-4.*

Ishi, et al. "Analysis of the roles and the dynamics of breathy and whispery voice qualities in dialogue speech." EURASIP Journal on Audio, Speech, and Music Processing 2010, Jan. 2010, 1-12.*

Lehana, et al. "Harmonic plus noise model based speech synthesis in Hindi and pitch modification." Proceedings of the 18th International Congress on Acoustics (ICA 2004, Kyoto, Japan). 2004, pp. 3333-3336.*

Lehana, et al . "The effect of SNR and GCI perturbation on speech synthesis with harmonic plus noise model." Jul. 2003, pp. 396-401.*

Mehta, et al. "Aspiration noise during phonation: Synthesis, analysis, and pitch-scale modification". Diss. Massachusetts Institute of Technology, Feb. 2006, pp. 1-145.*

Sun, Xuejing. "Voice quality conversion in TD-PSOLA speech synthesis." Acoustics, Speech, and Signal Processing, 2000. ICASSP'00. Proceedings. 2000 IEEE International Conference on. vol. 2. IEEE, Jun. 2000, pp. 11953-11956.*

Mohanty, Sanghamitra, et al. "An Approach to Proper Speech Segmentation for Quality Improvement in Concatenative Text-To-Speech System for Indian Languages." International Journal of Computer Processing of Oriental Languages 18.01, Mar. 2005, pp. 41-51.*

NakaMura etl al. "Integration of Spectral Feature Extraction and Modeling for HMM-Based Speech Synthesis." IEEE Trans. Inf. and Syst., vol. E97-D, No. 6, Jun. 2014, pp. 438-448.*

McCree, et al. "Mixed Excitation Prototype Waveform Interpolation for low bit rate speech coding." Speech Coding for Telecommunications, 1993. Proceedings., IEEE Workshop on. IEEE, 1993, pp. 51-52.*

Mehta, Daryush Daryush Dinyar. Aspiration noise during phonation: Synthesis, analysis, and pitch-scale modification. Diss. Massachusetts Institute of Technology, Feb. 2006, pp. 1-145.*

Sousa, et al. "The harmonic and noise information of the glottal pulses in speech." Biomedical Signal Processing and Control 10, Mar. 2014, pp. 137-143.*

Stylianou, Yannis. "Concatenative speech synthesis using a harmonic plus noise model." The Third ESCA/COCOSDA Workshop (ETRW) on Speech Synthesis, Nov. 1998, pp. 1-6.*

Yannis Stylianou, "Applying the Harmonic Plus Noise Model in Concatenative Speech Synthesis," IEEE Transactions on Speech and Audio Processing, vol. 9, No. 1, Jan. 2001, pp. 21-29.

Nakatani et al., "Mel-LSP Parameterization for HMM-based Speech Synthesis," Specom, St. Petersburg, Jun. 25-29, 2006, pp. 251-264.

Ian Vince McLoughlin, "A review of Line Spectral Pairs," School of Computer Engineering, Nanyang Technological University, 2007.

Kawahara et al., "Aperiodicity extraction and control using mixed mode excitation and group delay manipulation for a high quality speech analysis, modification and synthesis system STRAIGHT," ISCA Archive, Firenze, Italy, 2nd MAVEBA, Sep. 13-15, 2001, pp. 59-64.

Tokuda et al., "Mel-Generalized Cepstral Analysis—A Unified Approach to Speech Spectral Estimation," Proceedings of International Conference on Spoken Language Processing, vol. 3, pp. 1043-1046, Sep. 1994.

Hu et al., "An experimental comparison of multiple vocoder types," 8th ISCA Speech Synthesis Workshop, Aug. 31-Sep. 2, 2013, Barcelona, Spain, pp. 135-140.

Kawahara et al., "Restructuring speech representations using a pitch-adaptive time-frequency smoothing and an instantaneous-frequency-based F0 extraction: Possible role of a repetitive structure in sounds," Speech Communication 27 (1999), pp. 187-207.

Carnegie Mellon "Notes on Linear Prediction and Lattice Filters," Digital Signal Processing I, Fall Semester, 2005.

D'haes et al., "Discrete Cepstrum Coefficients as Perceptual Features," Proc. of the ICMC, 2003.

Cheveigne et al., "YIN, a fundamental frequency estimator for speech and music," J. Acoust. Soc. Am. vol. 111 No. 4, Apr. 2012, pp. 1917-1930.

AHOcoder, http://aholab.ehu.es/ahocoder/info.html, visited and printed from internet on May 10, 2014.

McAulay et al., "Sinusoidal Coding," Speech Coding and Synthesis, pp. 121-173, (2005).

Daniel W. Griffin, "Multi-Band Excitation Vocoder," RLE Technical Report No. 524, Mar. 1987.

History of Speech Synthesis 1770-1970, http://www2.ling.su.se/staff/harmut/kempine.htm, visited and printed from Internet on May 10, 2014.

Euphonia, http://www.haskins.yale.edu/featured/heads/SIMULACRA/euphonia.html, visited and printed from internet on May 10, 2014.

R. R. Riesz's talking mechanism 1937, http://www.haskins.yale.edu/featured/heads/simulacra/riesz.html, visited and printed from internet on May 10, 2014.

Homer Dudley, http://en.wikipedia.org/wiki/Homer_Dudley, visited and printed from internet on May 10, 2014.

FS-1015, http://en.wikipedia.org/wiki/FS-1015, visited and printed from internet on May 10, 2014.

DVSI, http://www.dvsinc.com/products/software.htm, visited and printed from internet on May 10, 2014.

STRAIGHT, http://www.wakayama-u.ac.jp/~kawahara/STRAIGHTadv/index_e.html, visited and printed from internet on May 10, 2014.

Irene Dahl, "Orator Verbis Electris. Speech Computer—a Pedagogical Link to Literacy. Development and Evaluation of Speech-Computer Based Training programs for Children with Reading and Writing Problems", Dissertation of the Faculty of Social Sciences, University of Umea, 1997.

(56) References Cited

OTHER PUBLICATIONS

Erro et al., "Harmonics Plus Noise Model Based Vocoder for Statistical Parametric Speech Synthesis," IEEE Journal of Selected Topics in Signal Processing, vol. 8, No. 2, Apr. 2014, pp. 184-194.
Agiomyrgiannakis et al., "ARX-LF-Based Source-Filter Methods for Voice Modification and Transformation," IEEE ICASSP, 2009, pp. 3589-3592.
Marine Campedel-Oudot, "Estimation of the Spectral Envelope of Voiced Sounds Using a Penalized Likelihood Aproach," IEEE Transactions on speech and Audio Processing, vol. 9, No. 5, Jul. 2001, pp. 469-481.
Agiomyrgiannakis et al., "Combined Estimation/Coding of Highband Spectral Envelopes for Speech Spectrum Expansion", Institute of Computer Science, IEEE 2004, I-469-I-472.
McAuley et al., "Computationally Efficient Sine-Wave Synthesis and Its Application to Sinusoidal Transform Coding", M.I.T., Lincoln Laboratory, IEEE 1988, pp. 370-373.
McCree et al., "A Mixed Excitation LPC Vocoder Model for Low Bit rate Speech Coding", IEEE Transactions on Speech and Audio Processing, vol. 3, No. 4, Jul. 1995, pp. 242-250.
Pantazis et al., "Improving The Modeling of the Noise Part in the Harmonic Plus Noise Model of Speech", Institute of computer Science, Forth, Crete, Greece, and Multimedia Informatics Lab, Computer Science Department, University of Crete, Greece, 2008.
Agiomyrgiannakis et al., "Towards Flexible Speech Coding for Speech Synthesis: an LF + Modulated Noise Vocoder", Orange Labs, Tech-SSTP-VMI, Sep. 22-26, 2008, pp. 1849-1852.
Kawahara et al., "Tandem-Straight: A Temporally Stable Power Spectral Representation for Periodic Signals and Applications To Interference-Free Spectrum, F0, and Aperiodicity Estimation", IEEE 2008, pp. 3933-3936.
McAulay et al., "Speech Analysis/Synthesis Based on a Sinusoidal", IEEE Transactions on Acoustics, Speech and Signal Processing, vol. ASSP-34, No. 4, Aug. 1986, pp. 744-754.

* cited by examiner

DEVICES AND METHODS FOR NOISE MODULATION IN A UNIVERSAL VOCODER SYNTHESIZER

CROSS-REFERENCE TO RELATED APPLICATION

This application claims priority to U.S. Provisional Patent Application Ser. No. 62/020,754, filed on Jul. 3, 2014, the entirety of which is herein incorporated by reference.

BACKGROUND

Unless otherwise indicated herein, the materials described in this section are not prior art to the claims in this application and are not admitted to be prior art by inclusion in this section.

A vocoder may include an analysis and synthesis system for reproducing human speech. As an example of vocoder analysis, the vocoder may generate a parametric representation of a speech signal. The parametric representation may be amenable to modification, encoding, quantization, and/or statistical processing. As an example of vocoder synthesis, the vocoder may utilize the parametric representation to generate a synthetic audio pronunciation of the speech.

SUMMARY

In one example, a method is provided that includes a device receiving an input indicative of acoustic feature parameters associated with speech. The device may include one or more processors. The method also includes determining a modulated noise representation for noise pertaining to one or more of an aspirate or a fricative in the speech based on the acoustic feature parameters. The aspirate may be associated with a characteristic of an exhalation of at least a threshold amount of breath. The fricative may be associated with a characteristic of airflow between two or more vocal tract articulators. The method also includes the device providing an audio signal indicative of a synthetic audio pronunciation of the speech based on the modulated noise representation.

In another example, a computer readable medium is provided. The computer readable medium may have instructions stored therein that when executed by a computing device, cause the computing device to perform functions. The functions comprise receiving an input indicative of acoustic feature parameters associated with speech. The functions further comprise determining a modulated noise representation for noise pertaining to one or more of an aspirate or a fricative in the speech based on the acoustic feature parameters. The aspirate may be associated with a characteristic of an exhalation of at least a threshold amount of breath. The fricative may be associated with a characteristic of airflow between two or more vocal tract articulators. The functions further comprise providing an audio signal indicative of a synthetic audio pronunciation of the speech based on the modulated noise representation.

In yet another example, a device is provided that comprises one or more processors and data storage configured to store instructions executable by the one or more processors. The instructions may cause the device to receive an input indicative of acoustic feature parameters associated with speech. The instructions may also cause the device to determine a modulated noise representation for noise pertaining to one or more of an aspirate or a fricative in the speech based on the acoustic feature parameters. The aspirate may be associated with a characteristic of an exhalation of at least a threshold amount of breath. The fricative may be associated with a characteristic of airflow between two or more vocal tract articulators. The instructions may also cause the device to provide an audio signal indicative of a synthetic audio pronunciation of the speech based on the modulated noise representation.

In still another example, a system is provided that comprises a means for a device receiving an input indicative of acoustic feature parameters associated with speech. The device may include one or more processors. The system further comprises a means for determining a modulated noise representation for noise pertaining to one or more of an aspirate or a fricative in the speech based on the acoustic feature parameters. The aspirate may be associated with a characteristic of an exhalation of at least a threshold amount of breath. The fricative may be associated with a characteristic of airflow between two or more vocal tract articulators. The system further comprises a means for the device providing an audio signal indicative of a synthetic audio pronunciation of the speech based on the modulated noise representation.

These as well as other aspects, advantages, and alternatives, will become apparent to those of ordinary skill in the art by reading the following detailed description, with reference where appropriate to the accompanying figures.

DETAILED DESCRIPTION

Figure 1:
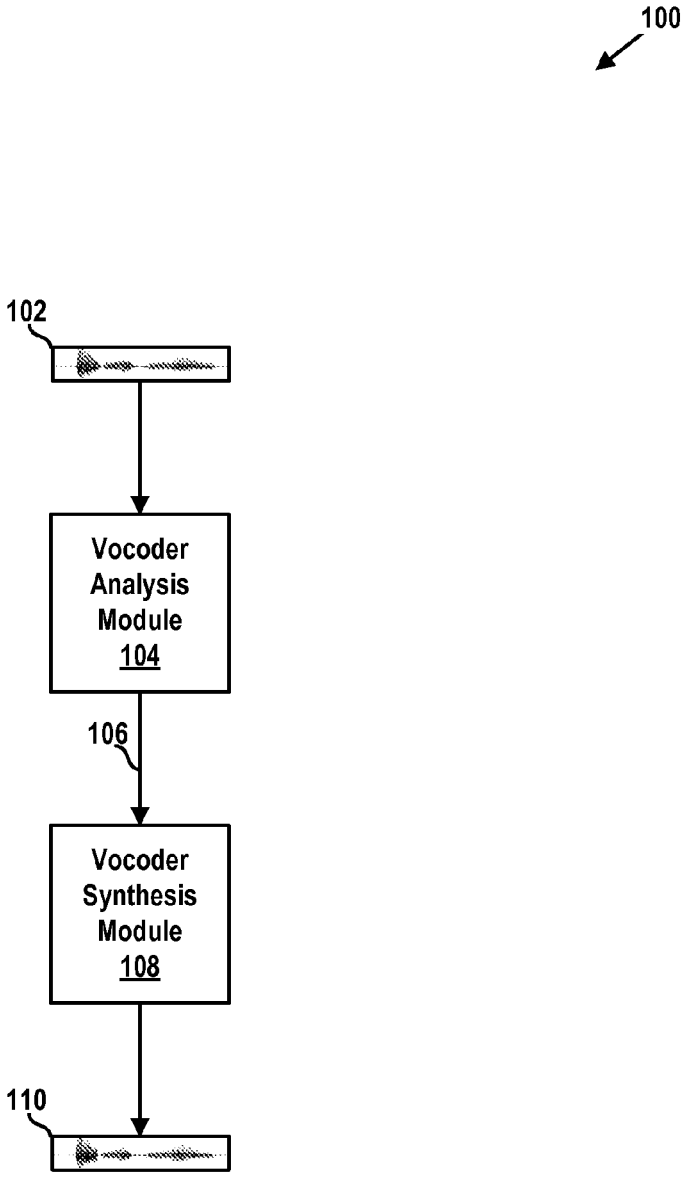
FIG. 1 illustrates a vocoder system, according to an example embodiment.

The following detailed description describes various features and functions of the disclosed systems and methods with reference to the accompanying figures. In the figures, similar symbols identify similar components, unless context dictates otherwise. The illustrative system, device and method embodiments described herein are not meant to be limiting. It may be readily understood by those skilled in the art that certain aspects of the disclosed systems, devices and methods can be arranged and combined in a wide variety of different configurations, all of which are contemplated herein.

Vocoder systems may be utilized in various applications of speech processing. For example, speech processing systems such as text-to-speech (TTS) systems may utilize a vocoder system to synthesize speech for various devices that include a speech-based user interface. Such devices may be utilized in residences, businesses, vehicles, or any other environment. For concatenative TTS synthesis, utilizing the vocoder system may allow such devices to reduce a size of a speech corpus by encoding speech signals in the corpus. For statistical parametric TTS synthesis, utilizing the vocoder system may allow statistical parametrization of speech signals that is amenable to statistical modeling and parameter generation. For example, a statistical TTS device may adjust voice characteristics of a speech signal (e.g., pitch, etc.) using data from a vocoder analyzer, and utilize a vocoder synthesizer to generate a synthetic audio pronunciation of the adjusted speech signal. Additionally, the vocoder system may allow fusing a concatenative TTS system with a statistical parameteric TTS system.

A vocoder may include an analysis unit for generating a parametric representation of a speech signal, and a synthesis unit for reconstructing a speech waveform using the parametric representation.

Within examples, a vocoder synthesis device is provided that is configured to process data from vocoder analysis systems having various types of parameterizations. Decoupling speech processing of the vocoder analysis systems from the parameter processing of the vocoder synthesis device in accordance with the present disclosure is advantageous for many reasons.

In one example, the vocoder synthesis device may be configured to utilize asynchronous phase information that is incompatible with the speech processing of the vocoder analysis systems to enhance speech quality of synthetic audio output of the vocoder synthesis device. In another example, the vocoder synthesis device may determine a modulated noise representation for noise pertaining to aspirates and/or fricatives in an input speech signal. The modulated noise representation, for example, may be determined in a frequency-domain and associated with harmonic frequencies of the speech signal. In turn, for example, the vocoder synthesis device may determine a representation for the speech signal that includes the modulated noise representation (e.g., aspiration/frication speech model) and other acoustic feature parameters of the speech signal (e.g., in the same frequency-domain space). Such representation, for example, may allow manipulation (e.g., modulation at run-time, etc.) of the noise to further enhance synthesized speech quality.

Accordingly, the vocoder synthesis device may be configured to provide an output audio signal indicative of a synthetic audio pronunciation of an input speech signal based on a modulation of the noise associated with the aspirates and/or fricatives in the input speech signal. Example methods and systems herein may therefore allow high-resolution, fast (e.g., low computational complexity), and flexible (e.g., universal) vocoder speech synthesis.

Referring now to the figures, FIG. 1 illustrates a vocoder system 100, according to an example embodiment. The system 100 includes a speech signal 102, a vocoder analysis module 104, acoustic feature parameters 106, a vocoder synthesis module 108, and a synthetic audio signal 110.

In some examples, functional blocks of the system 100, such as the vocoder analysis module 104 and/or the vocoder synthesis module 108, may be implemented as program instructions executable by one or more processors of a computing device to perform the functions described herein. Additionally, in some examples, the various functions of the system 100 may be performed by more than one computing device. Therefore, for example, the illustration of the system 100 in FIG. 1 may represent a conceptual block diagram of the vocoder system 100 that can be implemented according to various computing architectures that include one or more computing devices.

The speech signal 102 may be associated with speech content such as recorded audio speech from a particular speaker. For example, a microphone may output electronic signals that indicate various aspects of the speech content and/or other sounds in an environment of the microphone, and the speech signal 102 may be indicative of the electronic signals from the microphone.

The vocoder analysis module 104 may include various implementations to generate the acoustic feature parameters 106. Example implementations may include channel vocoders (e.g., STRAIGHT, TANDEM-STRAIGHT, etc.), AHOcoder, Sinusoidal Transform Codec, Multi-band Excitation Vocoder, LF-vocoder, Harmonic-plus-Noise model, a combination of these, or any other type of vocoder analysis implementation.

Depending on the implementation(s) utilized by the vocoder analysis module 104, the acoustic feature parameters 106 may include one or more of spectral parameters (e.g., spectral envelopes), aperiodicity parameters (e.g., aperiodicity envelopes), or phase parameters (e.g., phase envelopes). Spectral parameters, for example, may associate frequencies of the speech signal 102 with a timbre of the speech signal 102. Aperiodicity parameters, for example, may indicate distribution (e.g., noisiness, aperiodicity, etc.) of spectral content around a given frequency of the speech signal 102 (e.g., harmonic-to-noise power ratio, etc.). Further, the acoustic feature parameters 106 may have various types or formats according to the implementation utilized by the vocoder analysis module 104 to generate the acoustic feature parameters 106.

In some examples, the vocoder analysis module 104 may be configured to provide the acoustic feature parameters 106 as a sequence of speech frames. A given speech frame may include an acoustic feature representation of the speech signal 102 at a given time within a duration of the speech signal 102. In some examples, the sequence of speech frames may be provided at a fixed-rate. For example, adjacent speech frames may be separated by a given time-period (e.g., 5 ms, etc.).

The vocoder synthesis module 108 may be configured to receive any combination of the acoustic feature parameters 106 from the vocoder analysis module 104 to generate the synthetic audio signal 110. Therefore, methods and systems herein allow for processing the various types of the acoustic feature parameters 106 to provide fast and high-resolution speech synthesis of the synthetic audio signal 110. Accordingly, for example, the vocoder synthesis module 108 may correspond to a universal vocoder synthesizer.

In some examples, the vocoder synthesis module 108 may be configured to modify the acoustic feature parameters 106 to enhance speech quality of the synthetic audio signal 110 and/or to modify voice characteristics of the synthetic audio signal 110. For example, the vocoder synthesis module 108 may be configured to determine an aspiration and/or frication speech model for the speech signal 102, and may allow modulation of such speech models at run-time of the system 100. To facilitate such mode of synthesis, in some examples, the vocoder synthesis module 108 may perform pitch-synchronous synthesis to process a first pitch-period of speech followed by a second pitch-period of speech. Exemplary operation modes of the vocoder synthesis module 108 are described in greater detail in other embodiments of the present disclosure.

In some examples, the synthetic audio signal 110 may be structured as a sequence of synthetic speech sounds provided at a fixed-rate. For example, where processing by the vocoder synthesis module is in a pitch-synchronous mode, the vocoder synthesis module 108 may include output buffering to facilitate generating the fixed-rate sequence of synthetic speech sounds.

It is noted that the functional blocks in FIG. 1 are described in connection with functional modules for convenience in description. For example, the functional block in FIG. 1 shown as the vocoder analysis module 104 does not necessarily need to be implemented as being physically present in the same device as the vocoder synthesis module 108 but can be present in another memory included in another device (not shown in FIG. 1). For example, the vocoder analysis module 104 may be physically located in a remote server accessible to the vocoder synthesis module 108 via a network. Alternatively, for example, output of the vocoder analysis module 104 (e.g., the acoustic feature parameters 106) may be stored in a memory accessible by the vocoder synthesis module 108, and the vocoder synthesis module 108 may generate the synthetic audio signal 110 without any communication with the vocoder analysis module 104. Further, in some examples, embodiments of the system 100 may be arranged with one or more of the functional modules ("subsystems") implemented in a single chip, integrated circuit, and/or physical component.

Figure 2:
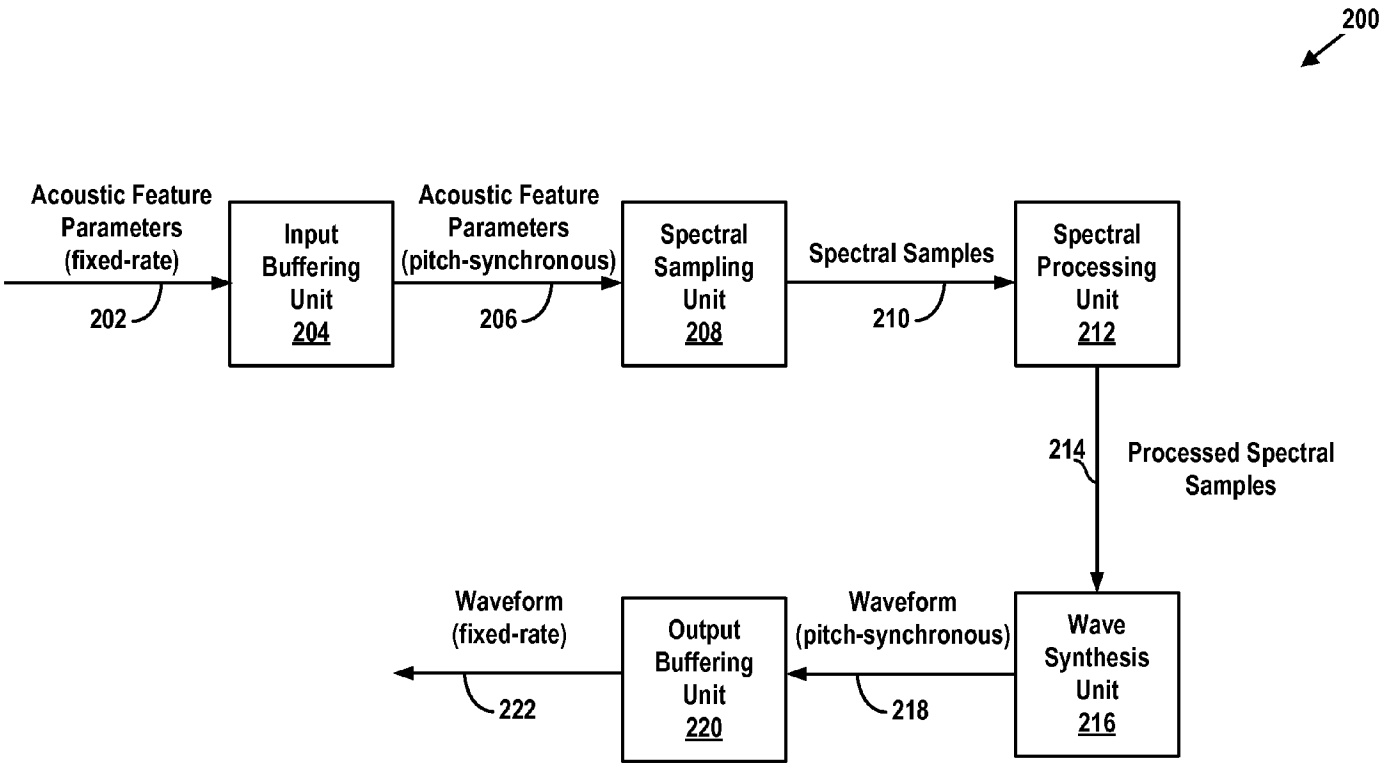
FIG. 2 illustrates a vocoder synthesis system, according to an example embodiment.

FIG. 2 illustrates a vocoder synthesis system 200, according to an example embodiment. The system 200 includes an input buffering unit 204, a spectral sampling unit 208, a spectral processing unit 212, a wave synthesis unit 216, and an output buffering unit 220. The system 200 may be similar to the vocoder synthesis module 108 of the system 100. For example, the system 200 may receive an input 202 that is similar to the acoustic feature parameters 106 of the system 100, and may provide an output 222 that is similar to the synthetic audio signal 110 of the system 100.

In some examples, functional blocks of the system 200 illustrated in FIG. 2 may be implemented as program instructions executable by one or more processors of a computing device to perform the functions described herein. Additionally, in some examples, the various functions of the system 200 may be performed by more than one computing device. Therefore, for example, the illustration of the system 200 in FIG. 2 may represent a conceptual block diagram of the vocoder synthesis system 200 that can be implemented according to various computing architectures that include one or more computing devices.

The input 202 may include acoustic feature parameters such as spectral parameters, aperiodicity parameters, and/or phase parameters similarly to the acoustic feature parameters 106 of the system 100. The acoustic feature parameters in the input 202 may be structured as a sequence of speech frames provided at a fixed-rate. A given speech frame may include the acoustic feature parameters that describe a speech signal at an analysis time instant of the speech signal (e.g., within the duration of the speech signal).

The input buffering unit 204 may be configured to receive the input 202 including the fixed-rate parameters, and generate pitch-synchronous parameters 206. The pitch-synchronous parameters 206 may correspond to a given sequence of speech frames from within the sequence of speech frames, where adjacent speech frames of the given sequence are separated by a given pitch period. Thus, for example, the system 200 may process one pitch period at a time using the pitch-synchronous parameters 206.

By way of example, a first speech frame in the given sequence of the parameters 206 may be associated with a first time. The input buffering unit 204 may determine a pitch period of the first speech frame and may provide a subsequent speech frame of the given sequence that is at a second time greater than the first time by the pitch period. Various methods for determining the pitch period are described in greater detail in other embodiments of the present disclosure.

The spectral sampling unit 208 may be configured to receive the pitch-synchronous parameters 206, and generate spectral samples 210 at harmonic frequencies of the speech signal indicated by the pitch-synchronous parameters 206. In some examples, the spectral samples 210 may include spectral parameters, aperiodicity parameters, and/or phase parameters mapped to the harmonic frequencies of the speech signal indicated by the pitch-synchronous parameters 206.

The spectral samples 210 may be received by the spectral processing unit 212 for modification of corresponding acoustic feature parameters to enhance speech quality, and to generate the processed spectral samples 214. In one example, the aperiodicity parameters may be reduced or increased according to characteristics of the speech signal in a particular speech frame. In another example, a dispersion factor may be applied by the spectral processing unit 212 to the phase parameters for certain speech frames. Other examples are possible as well and are described in greater detail in other embodiments of the present disclosure.

The processed spectral samples 214 may be received by the wave synthesis unit 216. In turn, the wave synthesis unit 216 may utilize the processed spectral samples 214 to generate pitch-synchronous audio signals 218. A given pitch-synchronous audio signal may have a duration that corresponds to the pitch period between adjacent samples of the processed spectral samples 214, and may correspond to a portion of the speech signal indicated by the input 202 that is associated with the duration. The given pitch-synchronous audio signal may be indicative of a synthetic speech waveform (e.g., sinusoidal speech model, etc.) for the duration. By processing the pitch-synchronous audio signals 218 in the pitch-synchronous mode, for example, the wave synthesis unit 216 may provide a speech model for noise (e.g., aspiration noise, frication noise, etc.), and may therefore improve synthetic speech quality of the output 222.

The output buffering unit 220 may receive the pitch-synchronous audio signals 218, and may generate the output 222 that is structured as a sequence of synthetic audio sounds provided at the fixed-rate. For example, a given synthetic audio sound in the sequence may have a duration of 5 ms, similarly to the time-period between adjacent speech frames of the input 202.

It is noted that functional blocks of the system 200 are illustrated in FIG. 2 as separate blocks for convenience. In some embodiments, the various functions described for the functional blocks of the system 200 may be implemented by one computing device. Additionally, in some examples, the various functions may be combined or separated in an alternative arrangement to the arrangement of FIG. 2. For example, a computing device may be configured to combine the functions of the spectral sampling unit 208 and the spectral processing unit 212. Accordingly, various implementations of the system 200 are described in greater detail within exemplary device, system and method embodiments of the present disclosure.

Figure 3:
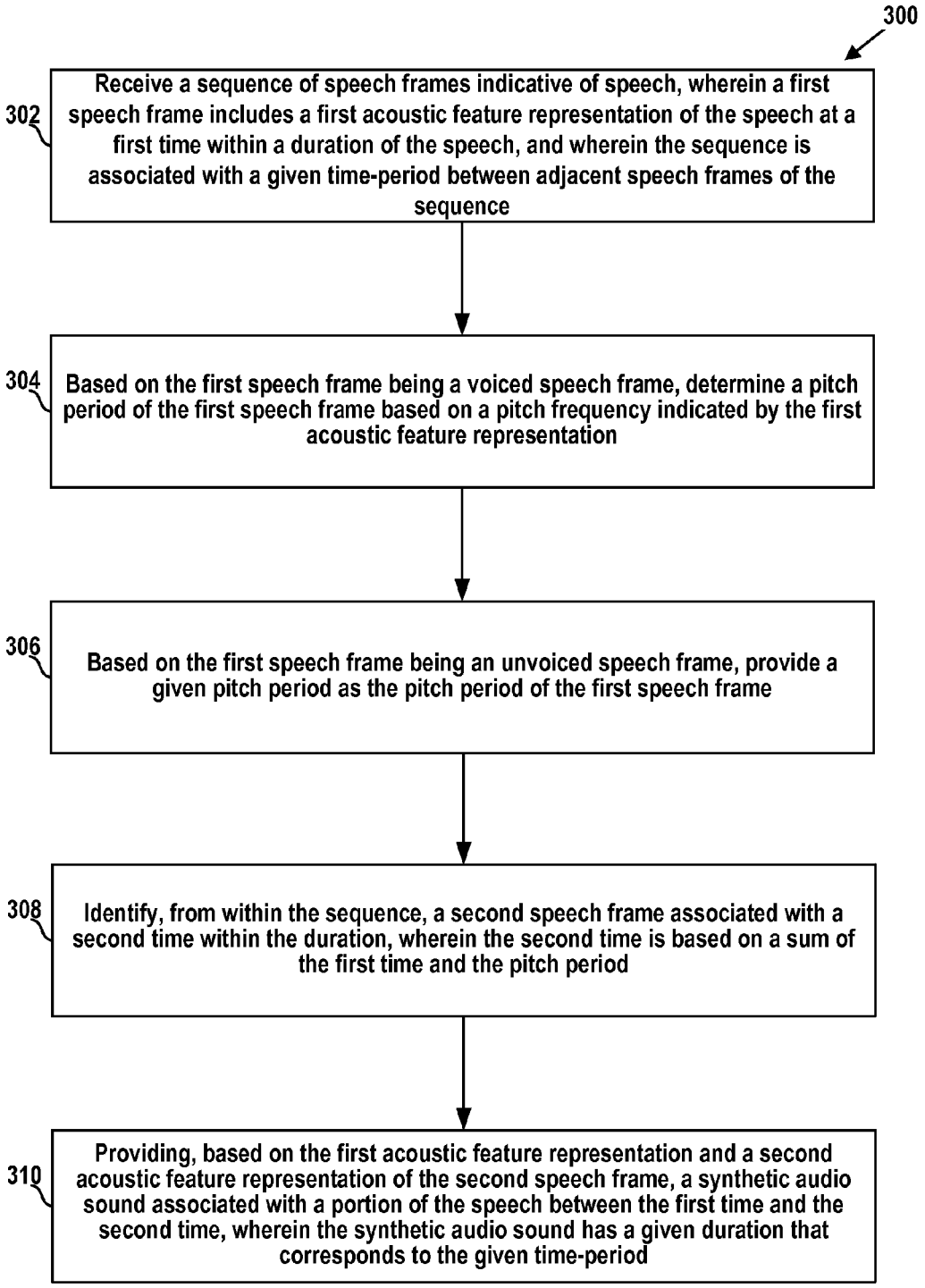
FIG. 3 is a block diagram of a method for pitch-synchronous vocoder synthesis, according to an example embodiment.

FIG. 3 is a block diagram of a method 300 for pitch-synchronous vocoder synthesis, according to an example embodiment. Method 300 shown in FIG. 3 presents an embodiment of a method that could be used with the systems 100 or 200, for example. Method 300 may include one or more operations, functions, or actions as illustrated by one or more of blocks 302-310. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 300 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In addition, for the method 300 and other processes and methods disclosed herein, each block in FIG. 3 may represent circuitry that is wired to perform the specific logical functions in the process.

In some examples, functions of the method 300 may be implemented by one or more components of the system 200 such as the input buffering unit 204 and/or the output buffering unit 220.

At block 302, the method 300 includes receiving a sequence of speech frames indicative of speech. A first speech frame may include a first acoustic feature representation of the speech at a first time within a duration of the speech. The sequence may be associated with a given time-period between adjacent speech frames of the sequence.

The sequence of speech frames may be similar to speech frames of the acoustic feature parameters 106 of the system 100 or speech frames of the input 202 of the system 200. For example, the first acoustic feature representation may be indicative of acoustic feature parameters such as spectral parameters, aperiodicity parameters, and/or phase parameters provided by a vocoder analysis system similar to the vocoder analysis module 104 of the system 100. Additionally, for example, the sequence of speech frames may be received and/or structured at a fixed-rate indicated by the given time-period. For example, the sequence of speech frames may be received by the method 300 at 200 speech frames/second (one every 5 ms).

At block 304, the method 300 includes determining a pitch period of the first speech frame based on a pitch frequency indicated by the first acoustic feature representation. The determination may be based also on the first speech frame being a voiced speech frame.

Voicing is a term used in phonetics and phonology to characterize speech sounds. A voiced speech sound may be articulated by vibration of vocal cords of a speaker. For example, a pronunciation of the letter "z" in the word "zebra" corresponds to the voiced phone [z], and the articulation thereof may cause the vocal cords to vibrate at a particular pitch frequency (e.g., fundamental frequency, etc.). Further, for example, a pronunciation of the letter "s" in the word "sing" corresponds to the voiceless (unvoiced) phone [s], and the articulation thereof may not cause the vocal cords to vibrate similarly.

The method 300 and other methods and systems herein may be configured to process input speech parameters (e.g., the sequence of speech frames) in a "pitch-synchronous" mode of operation that corresponds to processing one pitch period at a time, for example. In such pitch-synchronous mode, the method 300 may allow modeling and/or modification of speech characteristics that are associated with the pitch period, such as aspiration and/or frication speech characteristics.

Accordingly, in some examples, a device of the method 300 may determine that the first speech frame is a voiced speech frame based on the first acoustic feature representation of the first speech frame. In turn, the device may determine the pitch period of the first speech frame based on the pitch frequency of a speech sound associated with the first speech frame. For example, if the pitch frequency is 10 Hz, the pitch period may be determined as $1/10=100$ milliseconds (ms).

In some examples, the method 300 may also include identifying the first speech frame based on the first time corresponding to a voiced glottal closure time-instant of the speech. The voiced glottal closure time-instant may pertain to a characteristic of a closure of at least a portion of a glottis of a speaker for articulation of at least a portion of the speech. Thus, for the voiced speech frame, the voiced glottal closure time-instant may be selected as the first time for which the pitch period length speech sound may be processed by the method 300, for example. However, in some examples, other reference time-instants of a glottal cycle of the speech may be utilized for determination of the first time.

At block 306, the method 300 includes providing a given pitch period as the pitch period of the first speech frame based on the first speech frame being an unvoiced speech frame. For example, where the first acoustic feature representation indicates that the first speech frame is unvoiced (e.g., phone [s], etc.), the first speech frame may not have a pitch frequency. In turn, for example, the method 300 may provide the given pitch period as the pitch period to allow for the pitch-synchronous operation mode. In one example, the given pitch period may be a fixed amount such as 10 ms that is assigned when an unvoiced speech frame is detected. In other examples, the given pitch period may correspond to any other time period.

At block 308, the method 300 includes identifying a second speech frame from within the sequence that is associated with a second time within the duration of the speech. The second time may be based on a sum of the first time and the pitch period of the first speech frame. For example, if the pitch period is 15 ms and the given time-period between adjacent speech frames is 5 ms, the second speech frame may be at a distance of three speech frames to the first speech frame.

In some examples, the method 300 may also include identifying the first speech frame based on the first time corresponding to an unvoiced time-instant of the speech. For example, unvoiced speech sounds such as the phone [s] within the speech may be associated with the unvoiced time-instant, and in turn, the method 300 at block 306 may provide the given pitch period as the pitch period.

At block 310, the method 300 includes providing a synthetic audio sound based on the first acoustic feature representation and a second acoustic feature representation of the second speech frame. The synthetic audio sound may be associated with a portion of the speech between the first time and the second time. The synthetic audio sound may have a given duration that corresponds to the given time-period between the adjacent speech frames in the sequence.

For example, a system performing the method 300, such as the system 100 and/or 200, may process the first speech frame and the second speech frame (e.g., via blocks 208, 212, and/or 216 of the system 200) to generate the synthetic audio sound indicative of a pronunciation of the portion of the speech between the first time and the second time. Various methods may be utilized to generate the synthetic audio sound and are described in greater detail in embodiments of the present disclosure.

In some examples, the method 300 may also include determining a plurality of synthetic audio sounds associated with portions of the speech. For example, a second pitch period associated with the second acoustic feature representation may be similarly determined. In turn, a third speech frame that is at a distance of the second pitch period from the second speech frame may then be identified. Further, a second synthetic audio sound of the plurality of synthetic audio sounds may be provided based on the second acoustic feature representation of the second speech frame and a third acoustic feature representation of the third speech frame. Thus, for example, a system performing the method 300 such as the system 200, may perform the functions of the wave synthesis unit 216 and the output buffering unit 220.

Figure 4:
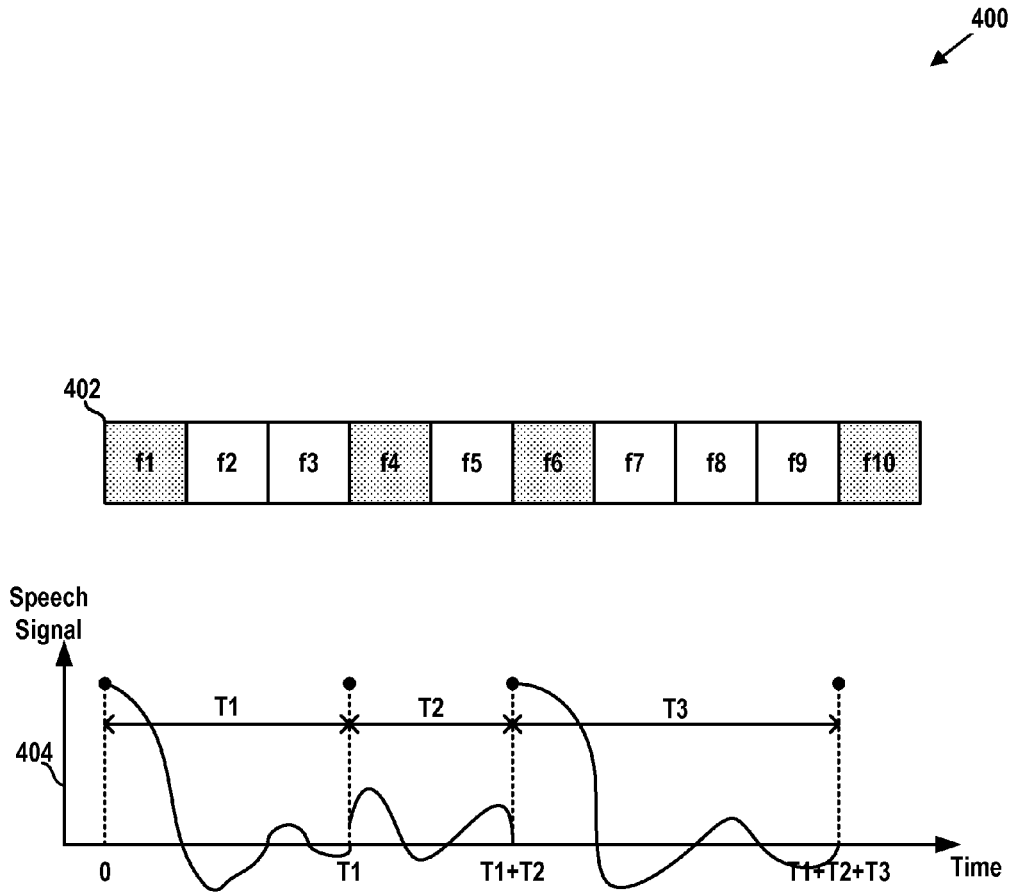
FIG. 4 illustrates a system for input buffering of speech frames, according to an example embodiment.

FIG. 4 illustrates a system 400 for input buffering of speech frames, according to an example embodiment. In some examples, the system 400 may illustrate an example implementation for the method 300 and/or the input buffering unit 204 of the system 200. The system 400 illustrates a buffer 402 and a speech waveform 404 associated with data in the buffer 402.

The buffer 402 may include any data structure such as a circular buffer. As illustrated in FIG. 4, the buffer 402 includes speech frames f1-f10 that may be similar to the acoustic feature parameters 106 of the system 100 and/or the input 202 of the system 200. For example, the speech frames f1-f10 may include a sequence of speech frames received from a vocoder analysis device (e.g., the vocoder analysis module 104), similarly to the sequence of speech frames at block 302 of the method 300. Although FIG. 4 shows that the buffer 402 includes ten speech frames f1-f10, in some examples, the buffer 402 may include less or more speech frames. To that end, in some examples, the buffer 402 may be configured to include at least enough speech frames for a maximum expected pitch period of input speech. Other configurations of the buffer 402 are possible as well.

The speech waveform 404 is illustrated in FIG. 4 along a space that includes a speech signal axis (e.g., vertical-axis) and a time axis (e.g., horizontal-axis). In some examples, functionality of systems and methods of the present disclosure may be performed in accordance with the system 400 as follows.

The system 400 may receive the speech frame f1 and store it in the buffer 402. The system may then determine the pitch period (T1) of the speech frame f1 based on acoustic feature parameters associated with the speech frame f1. For example, the acoustic feature parameters may indicate that the speech frame f1 is a voiced speech frame having a pitch period of 15 ms. Further, in some examples, as illustrated by the speech waveform 404, the speech frame f1 may include the acoustic feature parameters of the input speech at time t=0 ms. In turn, for example, if the speech frames f1-f10 are separated by a time-period of 5 ms, the speech frame f4 may be selected as the subsequent speech frame for processing (e.g., the second speech frame of the method 300), and the speech frames f1 and f4 may be provided to a spectral sampling unit (e.g., the spectral sampling unit 208) for vocoder speech synthesis. For example, the speech frame f4 may correspond to a time of t=T1.

Further, in the system 400, the speech frame f4 may be associated with an unvoiced speech frame. Accordingly, a given pitch period (T2) may be provided (e.g., 10 ms, etc.) such that the next speech frame provided may correspond to the speech frame f6. For example, the speech frame f6 may correspond to time t=T1+T2 within the speech wave form 404. At this point, the speech frame f6 may be associated with a voiced speech frame having a pitch period (T3) of 20 ms (e.g., pitch frequency of 50 hz) and therefore the speech frame f10 may be provided as the subsequent speech frame for processing by an example vocoder synthesis system. For example, the speech frame f10 may correspond to time t=T1+T2+T3 within the speech waveform 404.

Therefore, in the system 400, the speech frames f1, f4, f6, and f10 may be provided for pitch-synchronous vocoder speech synthesis.

Figure 5:
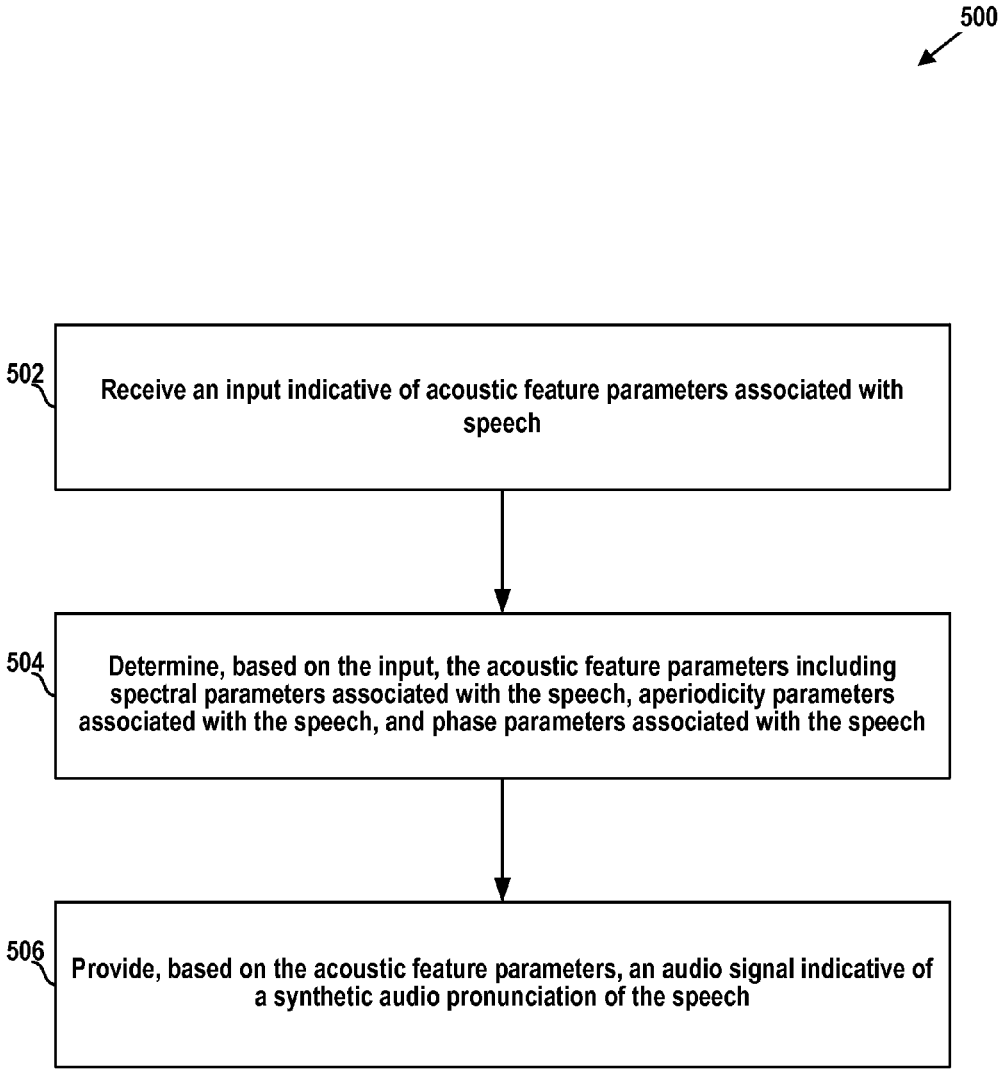
FIG. 5 is a block diagram of a method for spectral sampling in vocoder speech synthesis, according to an example embodiment.

FIG. 5 is a block diagram of a method 500 for spectral sampling in vocoder speech synthesis, according to an example embodiment. Method 500 shown in FIG. 5 presents an embodiment of a method that could be used with the systems 100, 200 and/or 400, for example. Method 500 may include one or more operations, functions, or actions as illustrated by one or more of blocks 502-506. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In some examples, functions of the method 500 may be implemented by one or more components of the system 200 such as the spectral sampling unit 208.

At block 502, the method 500 includes receiving an input indicative of acoustic feature parameters associated with speech. The input, for example, may be similar to the acoustic feature parameters 106 of the system 100 or the input 202 of the system 200.

At block 504, the method 500 includes determining the acoustic feature parameters including spectral parameters associated with the speech, aperiodicity parameters associated with the speech, and phase parameters associated with the speech.

Devices and systems of the present disclosure allow for receiving the acoustic feature parameters from various types of vocoder analysis systems (e.g., vocoder analysis module 104 of the system 100). Accordingly, in some examples, the method 500 at block 504 may be configured to determine a representation that includes the various acoustic feature parameters sampled at harmonic frequencies of the speech. Therefore, the method 500 allows for universality of an example vocoder synthesizer to receive the various types of vocoder analysis data and provide a representation for the data.

Example spectral parameter types may include Cepstrum, Mel-Cepstrum, Generalized Mel-Cepstrum, Discrete Mel-Cepstrum, Log-Spectral-Envelope, Auto-Regressive-Filter, Line-Spectrum-Pairs (LSP), Line-Spectrum-Frequencies (LSF), Mel-LSP, Reflection Coefficients, Log-Area-Ratio Coefficients, a combination of these, or any other type of spectral parameter. Example aperiodicity parameter types may include Mel-Cepstrum, log-aperiodicity-envelope, filterbank-based quantization, maximum voiced frequency, a combination of these, or any other type of aperiodicity parameter. Example phase parameter types may include minimum-phase, maximum-phase, sum-of-cosines pulse, sum-of-sines pulse, constant random pulse, a combination of these, or any other type of phase parameter. Other types of the acoustic feature parameters are possible as well, such as deltas or deta-deltas of the types described herein.

Accordingly, in some examples, the method 500 may also include receiving a selection indicative of selected types of the acoustic feature parameters from one or more of Cepstrum, Mel-Cepstrum, Generalized-Mel-Cepstrum, Discrete Mel-Cepstrum, Log-Spectral, Auto-Regressive, Line-Spectrum-Pairs, Line-Spectrum-Frequencies, Mel-Line-Spectrum-Pairs, Reflection Coefficients, Log-Area-Ratio Coefficients, minimum-phase, maximum-phase, sum-of-cosines pulse, sum-of-sines pulse, constant random pulse, log-aperiodicity, filterbank-based quantization, or maximum voiced frequency. In these examples, determining the acoustic feature parameters may be based on the selection.

In examples that include such selection, the method 500 may determine the acoustic feature parameters including the spectral parameters, the aperiodicity parameters, and the phase parameters while associating the various acoustic feature parameters with the same harmonic frequencies.

By sampling the acoustic feature parameters at the harmonic frequencies, an order of the speech parameterization may be unconstrained or may be marginally constrained, thereby allowing high-resolution speech processing. For example, the acoustic feature parameters may be sampled exactly at glottal closure time-instants (e.g., pitch-synchronous mode), similarly to the method 300. In this example, the method 500 may determine the phase parameters at the harmonic frequencies as well as the spectral parameters and the aperiodicity parameters.

Accordingly, in some examples, the determined phase parameters may be based on measured phase values indicated in the input and associated with one or more particular times within a duration of the speech. The one or more particular times, for example, may correspond to the glottal closure time-instants.

In some examples, where the input includes a sequence of speech frames similarly to the method 300, the pitch period may be quantized to an integer value according to a sampling rate (e.g., fixed rate, etc.) of the input sequence of speech sounds according to equation [1] below.

$$\hat{f}_0 = F_S * \text{round}\left(\frac{F_S}{f_0}\right) \quad [1]$$

In the equation [1], $\hat{f}_0$ may be the quantized pitch period, $f_0$ may be the pitch period, and $F_s$ may be the sampling rate. In the example of the system 400, $F_s$ may be based on the given tip e-period (e.g., at block 302) between adjacent speech frames in the input. Such quantization may simplify processing of the acoustic feature parameters during wave synthesis (e.g., wave synthesis unit 216 of the system 200).

Additionally, in some examples, sampled harmonic amplitudes of the spectral parameters may be power normalized according to equation [2] below.

$$\tilde{A}_l = A_l * \sqrt{\frac{2f_0}{F_S}} \quad [2]$$

In the equation [2], $\tilde{A}_l$ may correspond to the power normalized amplitude $A_l$ may correspond to the sampled harmonic amplitude of the spectral parameters.

At block 506, the method 500 includes providing an audio signal indicative of a synthetic audio pronunciation of the speech based on the acoustic feature parameters. Various methods may be employed for providing the audio signal such as by a unit of the system 200 (e.g., units 212, 216, and/or 220). It is noted that providing the audio signal is, in some examples, based on a representation that includes all the acoustic feature parameters (e.g., spectral, aperiodicity, and phase) based on the sampling at harmonic frequencies at block 504. Thus, various advantages may be realized in accordance with the method 500, such as high-resolution processing and specialized speech models (e.g., for aspiration and/or frication speech).

Figure 6:
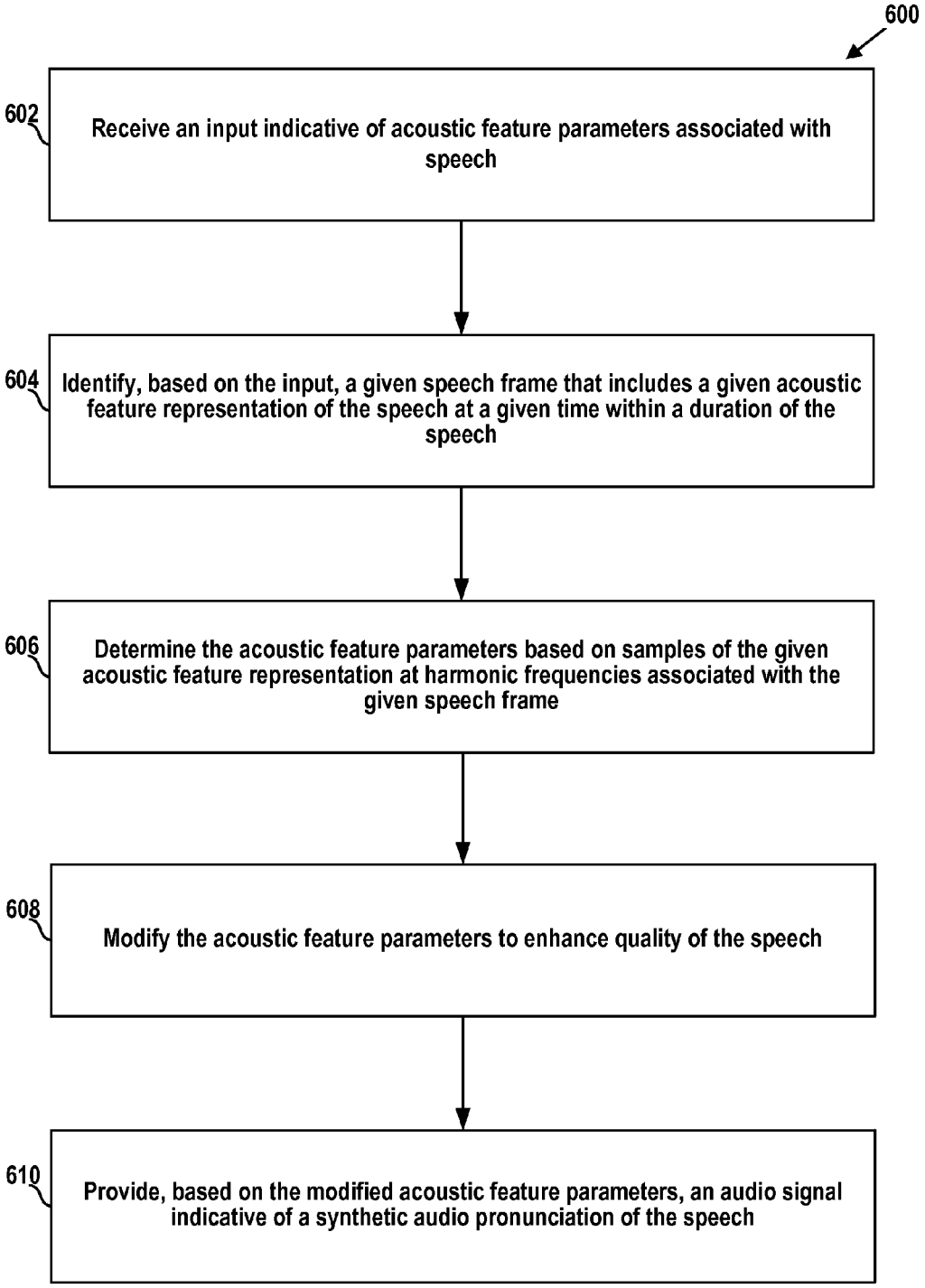
FIG. 6 is a block diagram of a method for harmonic spectra processing in vocoder speech synthesis, according to an example embodiment.

FIG. 6 is a block diagram of a method 600 for harmonic spectra processing in vocoder speech synthesis, according to an example embodiment. Method 600 shown in FIG. 6 presents an embodiment of a method that could be used with the systems 100, 200 and/or 400, for example. Method 600 may include one or more operations, functions, or actions as illustrated by one or more of blocks 602-610. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In some examples, functions of the method 600 may be implemented by one or more components of the system 200 such as the spectral processing unit 212.

At block 602, the method 600 includes receiving an input indicative of acoustic feature parameters associated with speech. The input, for example, may be similar to the acoustic feature parameters 106 of the system 100 or the input 202 of the system 200.

At block 604, the method 600 includes identifying a given speech frame that includes a given acoustic feature representation of the speech at a given time within a duration of the speech. The given speech frame may correspond, for example, to one of the speech frames f1-f10 in the buffer 402 of the system 400. Therefore, for example, the given time may correspond to a voiced glottal closure time-instant or an unvoiced time-instant similarly to blocks 304-306 of the method 300.

At block 606, the method 600 includes determining the acoustic feature parameters based on samples of the given acoustic feature representation at harmonic frequencies associated with the given speech frame. Similarly to block 504 of the method 500, for example, the acoustic feature parameters may include spectral parameters, aperiodicity parameters, and/or phase parameters.

At block 608, the method 600 includes modifying the acoustic feature parameters to enhance quality of the speech. For example, the acoustic feature parameters such as aperiodicity parameters may be modified to reduce noisiness of the given speech frame. In turn, for example, phase parameters may be modified to include random dispersion according to the modified aperiodicity parameters.

In one example, the given speech frame may correspond to an unvoiced speech frame. In this example, the method 600 may include modifying the acoustic feature parameters for the given speech frame that are associated with given harmonic frequencies less than a threshold. For example, for the given harmonic frequencies less than 500 Hz, the method 600 may apply a suppression function to harmonic amplitudes to mitigate vocoder analysis errors. Further, in this example, the method 600 may also include modifying phase parameters of the given speech frame to correspond to random values (e.g., in the range $[-\pi, \pi]$).

In another example, the given speech frame may correspond to a voiced speech frame. In this example, the method 600 may include modifying aperiodicity parameters of the given speech frame to correspond to: a first value for first harmonic frequencies greater than a threshold, a second value for second harmonic frequencies less than a second threshold, and one or more values between the first value and the second value for given harmonic frequencies less than the first threshold and greater than the second threshold. For example, the aperiodicity parameters having the first harmonic frequencies greater than 4.4 kHz (e.g., the first threshold) may be set to a value of 1, the aperiodicity parameters having the second harmonic frequencies less than 1 kHz (e.g., the second threshold) may be set to a value of 0, and the aperiodicity parameters for the given harmonic frequencies (e.g., between 1 kHz and 4.4 kHz) may be assigned values between 0 and 1. Thus, in this example, the noisiness corresponding to the aperiodicity parameters may be reduced, at least for the first harmonic frequencies and the second harmonic frequencies. In some examples, such process may be employed when the given speech frame is "deeply" within a voice region of the speech. For example, the modification of the aperiodicity parameters may be performed if the given speech frame is at a threshold (e.g., 20 ms, etc.) time from the last unvoiced speech frame processed by the method 600.

In some examples, modifying the aperiodicity parameters may also include monotonically increasing the one or more values associated with the given harmonic frequencies, to further reduce noisiness associated with the given harmonic frequencies (e.g., between 1 kHz and 4.4 kHz, etc.). Equation [3] below illustrates an example for the monotonic increase.

$$\hat{\alpha}_1 = f(\alpha_l) \quad [3]$$

In the equation [3], $\hat{\alpha}_1$ may correspond to the monotonically increased aperiodicity, $\alpha_l$ may correspond to the modified periodicity (e.g., having valued between 0 and 1) prior to the monotonic increase, and $f(\alpha_l)$ may correspond to the monotonically increasing function. Equation [4] below illustrates the operation of the monotonically increasing function $f(\alpha_l)$.

$$\hat{\alpha}_l \geq \alpha_l \quad [4]$$

Additionally, in some examples, the method 600 may include determining a dispersion factor for phase parameters of the given speech frame based on the modified aperiodicities, and modifying the phase parameters based on the dispersion factor. Equation [5] below illustrates example modification of the phase parametres.

$$\hat{\phi}_l = \phi_l + \hat{\alpha}_l U \quad [5]$$

In the equation [5], $\phi_l$ may correspond to the phase $\hat{\phi}_l$ may correspond to the modified phase parameters, $\hat{\alpha}_l U$ may correspond to the dispersion factor, and U may correspond to a uniform random value (e.g. in the range $[-1, 1]$).

At block 610, the method 600 includes providing an audio signal indicative on a synthetic audio pronunciation of the speech based on the modified acoustic feature parameters. Various methods of the present disclosure may be employed for providing the audio signal similarly to the wave synthesis unit 216 of the system 200.

Figure 7:
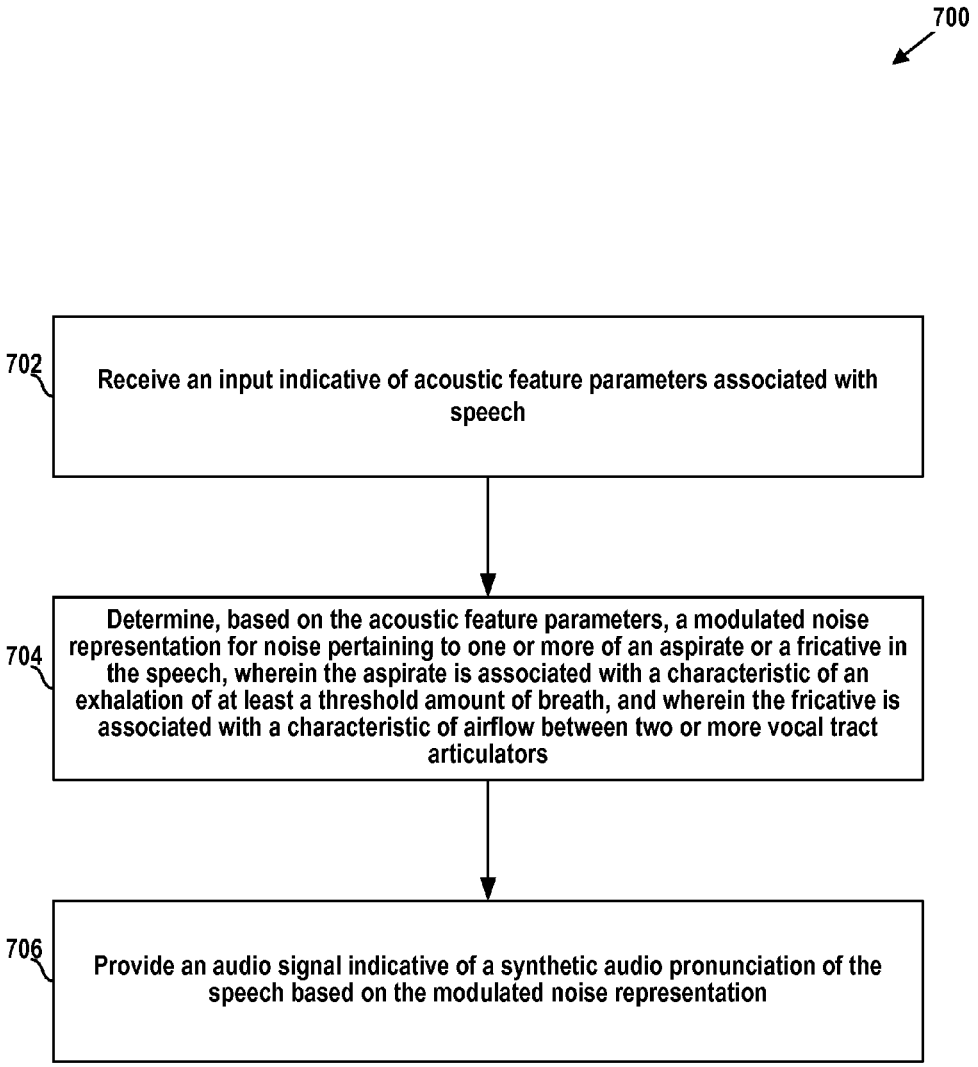
FIG. 7 is a block diagram of a method for vocoder speech synthesis that includes a speech model for aspirates and/or fricatives, according to an example embodiment.

FIG. 7 is a block diagram of a method 700 for vocoder speech synthesis that includes a speech model for aspirates and/or fricatives, according to an example embodiment. Method 700 shown in FIG. 7 presents an embodiment of a method that could be used with the systems 100, 200 and/or 400, for example. Method 700 may include one or more operations, functions, or actions as illustrated by one or more of blocks 702-706. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In some examples, functions of the method 700 may be implemented by one or more components of the system 200 such as the wave synthesis unit 216.

At block 702, the method 700 includes receiving an input indicative of acoustic feature parameters associated with speech. The input, for example, may be similar to the acoustic feature parameters 106 of the system 100 or the input 202 of the system 200.

At block 704, the method 700 includes determining a modulated noise representation for the speech based on the acoustic feature parameters. The modulated noise representation may, for example, allow modulating noise pertaining to one or more of an aspirate or a fricative in the speech. The aspirate may be associated with a characteristic of an exhalation of at least a threshold amount of breath. The fricative may be associated with a characteristic of airflow between two or more vocal tract articulators.

In some examples, the speech may include articulation of various speech sounds that involve exhalation of breath. Such articulation may be described as aspiration and/or frication, and may cause noise in the input speech signal. An example aspirate may correspond to the pronunciation of the letter "p" in the word "pie." During articulation of such aspirate, the at least threshold amount of breath may be exhaled by a speaker pronouncing the word "pie." In turn, an audio recording of the pronunciation of the speaker may include breathing noise due to the exhalation. Accordingly, in some examples, the method 700 and other systems and methods herein may include determining the modulated noise representation for such speech (e.g., the aspirate).

Further, in some examples, the speech may include the fricative that is associated with airflow between two or more vocal tract articulators. A non-exhaustive list of example vocal tract articulators may include a tongue, lips, teeth, gums, palate, etc. Noise due to such fricative speech may also be characterized by the method 700, to enhance quality of synthesized speech. For example, breathing noise due to airflow between a lip and teeth may be different from breathing noise due to airflow between a tongue and teeth.

Further, for example, the fricative speech may be included in voiced speech and/or unvoiced speech. Voicing is a term used in phonetics and phonology to characterize speech sounds. A voiced speech sound may be articulated by vibration of vocal cords of a speaker. For example, a pronunciation of the letter "z" in the word "zebra" corresponds to the voiced phone [z], and the articulation thereof may cause the vocal cords to vibrate at a particular pitch frequency (e.g., fundamental frequency, etc.). Further, for example, a pronunciation of the letter "s" in the word "sing" corresponds to the voiceless (unvoiced) phone [s], and the articulation thereof may not cause the vocal cords to vibrate similarly.

Accordingly, the modulated noise representation determined at block 704 may modulate the speech to account for such differences (e.g., voiced/unvoiced, frication, aspiration, etc.) and allow modulation of corresponding noise accordingly to enhance quality of synthesized speech.

Table 1 below illustrates example fricatives in the English language. In the example of the first row in Table 1, a pronunciation of the letter "f" in the word "fan" (e.g., corresponding to the phone [f]) may be associated with airflow between the lower lip and the teeth, and may be unvoiced (e.g., no vibration of the vocal cords). Further, in the example, a pronunciation of the letter "v" in the word "van" (e.g., corresponding to the phone [v]) may also be associated with the airflow between the lower lip and the teeth, but may be voiced (e.g., vibration of the vocal chords at a pitch frequency). Other vocal tract articulators than the vocal tract articulators illustrated in Table 1 are possible, and positions of the vocal tract articulators may also be different than those illustrated in Table 1. For example, other languages such as French may include additional and/or alternative voiced fricatives.

TABLE 1

| Vocal Tract Articulator Positions | Unvoiced speech sound | Voiced speech sound |
|---|---|---|
| Lower lip against the teeth | [f] (*f*an) | [v] (*v*an) |
| Tongue against the teeth | [θ] (*th*in) | [ð] (*th*en) |
| Tongue near the gums | [s] (*s*ip) | [z] (zip) |
| Tongue compressed towards palate | [ʃ] (Confu*c*ian) | [ʒ] (confu*s*ion) |

In some examples, the speech indicated by the input may be processed in a pitch-synchronous mode (e.g., method 300), and the acoustic feature parameters may be determined and processed at harmonic frequencies (e.g., methods 500-600). In turn, the method 700 at block 704 may provide a representation (e.g., speech model) of the speech indicated by the input based on the acoustic feature parameters. Such representation may be compatible with any type of speech (e.g., periodic, aperiodic, semi-periodic, etc.) in high resolution. Equation [6] below illustrates such representation.

$$s(n)=A_1(n)\cos(\phi_1(n))+\Sigma_{k=2}^{K}A_k(n)[\gamma_0+\gamma_1\alpha_k(n)\cos(\phi_1(n))]\cos(\phi_k(n)) \quad [6]$$

In equation [6], s(n) may correspond to the representation of the speech, K may correspond to the number of the harmonics, n may correspond to a time index (e.g., 2, . . . , T, where T is the synthesis period or the pitch period of the method 300), $A_k$ (n) may correspond to the instantaneous amplitude of a k-th harmonic, $\phi_k$ (n) may correspond to the instantaneous phase of the k-th harmonic, $\alpha_k$ (n) may correspond to the instantaneous aperiodicity of the k-th harmonic (e.g., in the range [0, 1]), $\gamma_0$ may correspond to a modulation bias (e.g., 1.2), and $\gamma_1$ may correspond to a modulation factor (e.g., 0.5).

As illustrated in equation [6], the representation of the speech (s(n)) includes the modulated noise representation associated with the aspirate and/or the fricative. Equation [7] below identifies the modulated noise representation ($g_k$(n)) that is included in equation [6].

$$g_k(n)=\gamma_0+\gamma_1\alpha_k(n)\cos(\phi_1(n)) \quad [7]$$

Accordingly, in some examples, the method 700 may include determining a representation (e.g., equation [6]) of the speech that includes the acoustic feature parameters mapped to harmonic frequencies of the speech (e.g., k=2, . . . , K). In these examples, the representation may also include the modulated noise representation (e.g., $g_k$(n) of equation [7]) mapped also to the harmonic frequencies. Further, in these examples, the representation may include one or more modulation factors (e.g., $\gamma_0$ and/or $\gamma_1$) in the modulated noise representation. For example, such representation may correspond to a sinusoidal speech model for the speech indicated by the input that is augmented to include a noise modulation model (e.g., the modulated noise representation ($g_k$ (n)).

At block 706, the method 700 includes providing an audio signal indicative of a synthetic audio pronunciation of the speech based on the modulated noise representation.

The modulated noise representation ($g_k$(n)) of equation [7], for example, may correspond to an explicit aspiration and/or frication model. Accordingly, the method 700 may allow incorporating aspiration noise into the speech signal representation (equation [6]) to enhance quality of the audio signal at block 706. Further, the modulated noise representation may also allow modeling (and/or modulating associated noise of) fricatives and/or other breathy/lax speech characteristics. By incorporating the modulated noise representation in the speech model (e.g., the representation) of the speech, in some examples, the audio signal may simulate aspiration/frication noise patterns of actual phonation sounds.

In some examples, the method 700 may receive the input at block 702 as a sequence of speech sounds similarly to the method 300. Similarly to the method 300, in these examples, the method 700 may process two speech frames that correspond to a left speech frame and a right speech frame bordering a pitch period. Further, in some examples, the equations [6]-[7] may be modified by the method 700 to process the two speech frames according to types (e.g., voiced, unvoiced) of the two speech frames. Table 2 below illustrates four different possibilities for the speech frame types.

TABLE 2

| Left Speech Frame | Right Speech Frame |
|---|---|
| Unvoiced | Unvoiced |
| Unvoiced | Voiced |
| Voiced | Unvoiced |
| Voiced | Voiced |

By way of example, the method 700 may match harmonics (e.g., sinusoids) of the left speech frame and the right speech frame based on satisfying particular criteria. For example, the particular criteria may include the left speech frame and the right speech frame being a same type (e.g., voiced-voiced or unvoiced-unvoiced) that correspond to the first and last rows of the Table 2. Further, the particular criteria may include voiced harmonics (e.g., last row of Table 2) being matched based on a difference between the harmonic frequencies of the left speech frame and the right speech frame being less than a threshold (e.g., 30%). If the particular criteria are not met, in some examples, other speech processing techniques may be utilized such as fade-in/fade-out windows.

As an example for matching harmonics, a single matched harmonic ($s_k(n)$) may be represented by equation [8] below.

$$s_k(n)=A_k(n)[\gamma_0+\gamma_1\alpha_k(n)\cos(\phi_1(n))]\cos(\phi_k(n)) \quad [8]$$

In equation [8], the instantaneous amplitude ($A_k(n)$) and the instantaneous aperiodicity ($\alpha_k(n)$) may be determined based on a linear interpolation between the corresponding left speech frame and right speech frame acoustic feature parameters. Alternatively, other types of interpolation may be utilized such as splines, etc. For the instantaneous phase ($\phi_k(n)$), other types of interpolation (e.g., cubic phase interpolation, etc.) may be utilized by the method 700 that are suitable for modulo-n (circular) nature of phase parameters.

Figure 8:
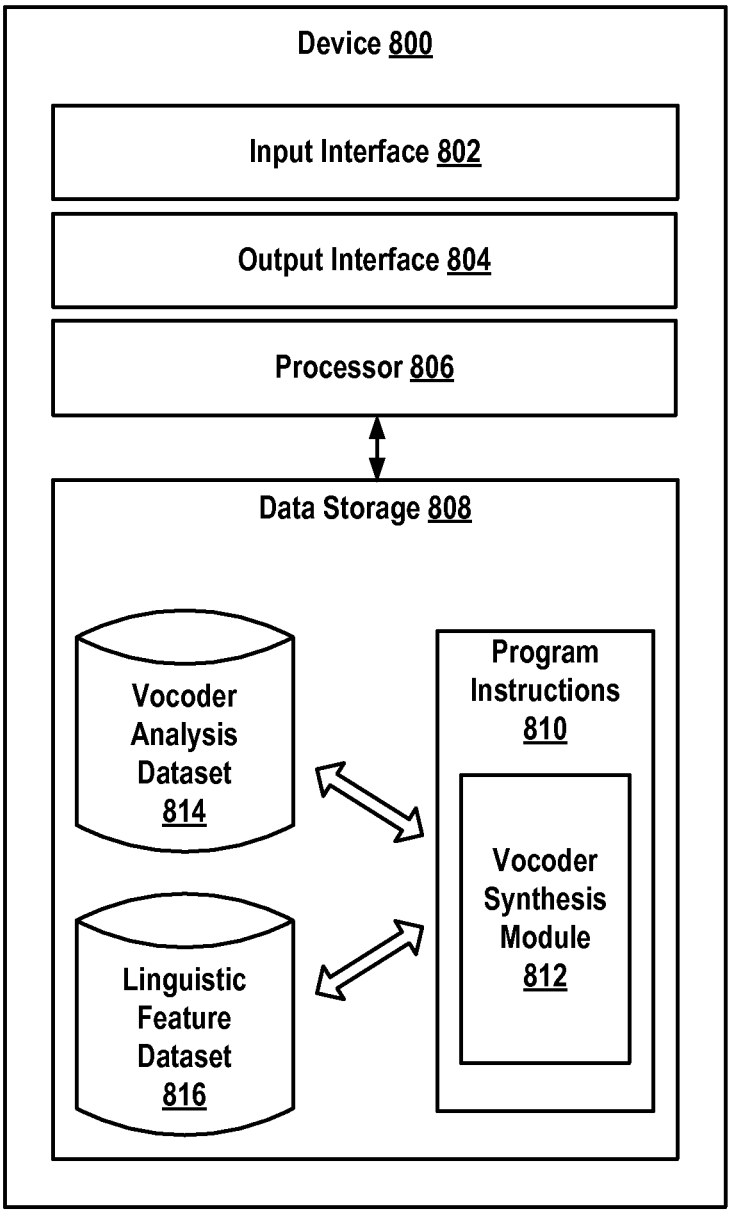
FIG. 8 illustrates a device, according to an example embodiment.

FIG. 8 illustrates a device 800, according to an example embodiment. The device 800 includes an input interface 802, an output interface 804, a processor 806, and data storage 808. The device 800 may be configured to perform some or all the functions of systems and methods herein such as the systems 100, 200, 400 and/or the methods 300, 500-700.

The device 800 may include a computing device such as a smart phone, digital assistant, digital electronic device, body-mounted computing device, personal computer, or any other computing device configured to execute program instructions 810 included in the data storage 808 to operate the device 800. The device 800 may include additional components (not shown in FIG. 8), such as a camera, an antenna, or any other physical component configured, based on the program instructions 810 executable by the processor 806, to operate the device 800. The processor 806 included in the device 800 may comprise one or more processors configured to execute the program instructions 810 to operate the device 800.

The input interface 802 may include an input device such as a microphone or any other component configured to provide an input signal comprising audio content associated with speech to the processor 806. The output interface 804 may include an audio output device, such as a speaker, headphone, or any other component configured to receive an output audio signal from the processor 806, and output sounds that may indicate synthetic speech content based on the output audio signal.

Additionally or alternatively, the input interface 802 and/or the output interface 804 may include network interface components configured to, respectively, receive and/or transmit the input signal and/or the output signal described above. For example, an external computing device (e.g., server, etc.) may provide the input signal (e.g., speech content, acoustic feature parameters, sequence of speech frames, etc.) to the input interface 802 via a communication medium such as Wifi, WiMAX, Ethernet, Universal Serial Bus (USB), or any other wired or wireless medium. Similarly, for example, the external computing device may receive the output signal from the output interface 804 via the communication medium described above.

The data storage 808 may include one or more memories (e.g., flash memory, Random Access Memory (RAM), solid state drive, disk drive, etc.) that include software components configured to provide the program instructions 810 executable by the processor 806 to operate the device 800. Although illustrated in FIG. 8 that the data storage 808 is physically included in the device 800, in some examples, the data storage 808 or some components included thereon may be physically stored on a remote computing device. For example, some of the software components in the data storage 808 may be stored on a remote server accessible by the device 800. The data storage 808 may include the program instructions 810 and a vocoder analysis dataset 814. In some examples, the data storage 808 may optionally include a linguistic feature dataset 816.

The program instructions 810 include a vocoder synthesis module 812 to provide instructions executable by the processor 806 to cause the device 800 to perform functions of the present disclosure. For example, the functions may include generating a synthetic speech audio signal via the output interface 804, in accordance with the systems 100, 200, 400, and/or the methods 300, 500-700. For example, the vocoder synthesis module 812 may be similar to the vocoder synthesis module 108 of the system 100 and/or the vocoder synthesis system 200. The vocoder synthesis module 812 may comprise, for example, a software component such as an application programming interface (API), dynamically-linked library (DLL), or any other software component configured to provide the program instructions 810 to the processor 806.

The vocoder analysis dataset 814 may include data from a vocoder analysis module such as the vocoder analysis module 104 of the system 100. For example, the vocoder analysis dataset may include a sequence of speech frames indicative of acoustic feature parameters pertaining to the speech indicated by the input interface 802. Such sequence, for example, may be received by the vocoder synthesis module 812 to provide a synthetic audio signal output via the output interface 804 (e.g., in accordance with the methods 300 and/or 500-700).

To facilitate the operation of the vocoder synthesis module 812, in some examples, the linguistic feature dataset may be included in the data storage 808 and may be utilized to determine the sequence of speech frames from the vocoder analysis dataset 814. For example, the linguistic feature dataset may include one or more phonemes that correspond to text for which the device 800 is configured to provide the output synthetic audio signal. Accordingly, for example, the vocoder synthesis module 812 may obtain vocoder analysis data from the vocoder analysis dataset 814 that corresponds to the one or more phonemes indicated in the linguistic feature dataset 816, and provide the synthetic audio signal that corresponds to such data.

Figure 9:
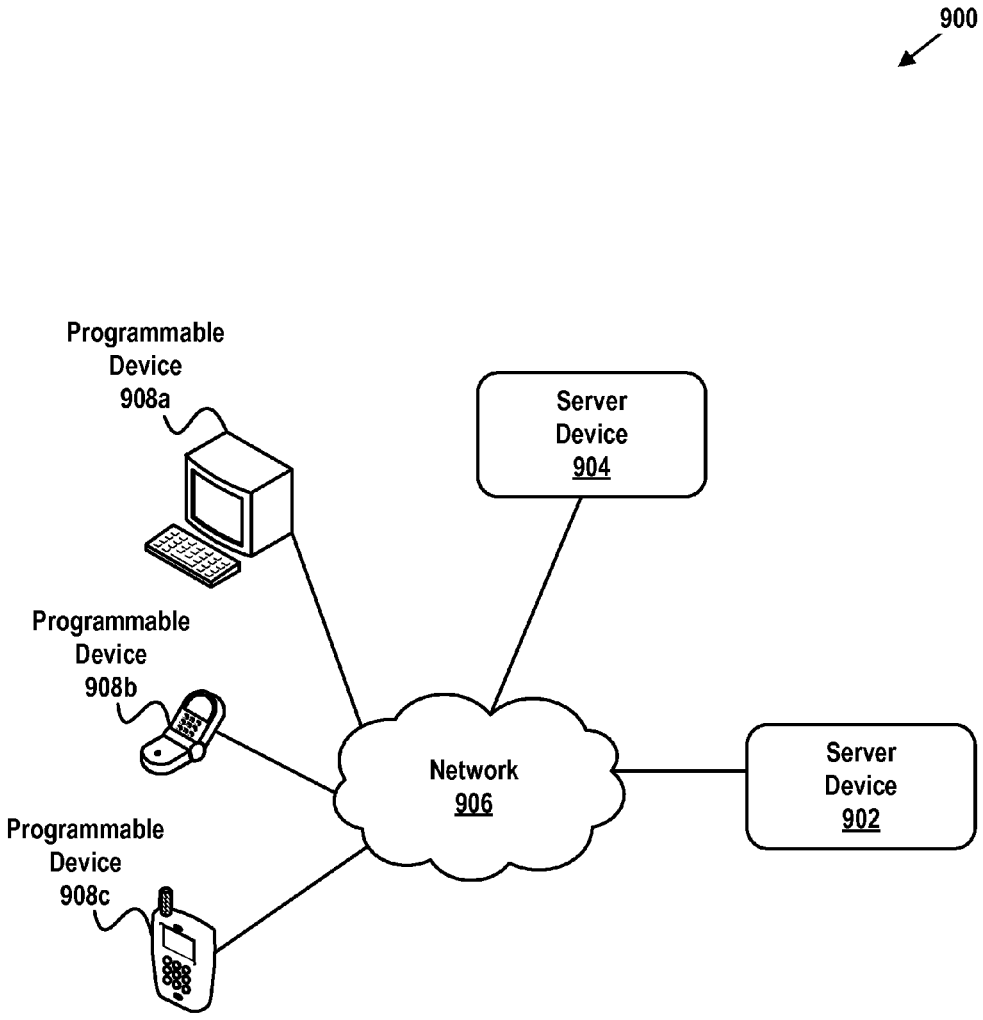
FIG. 9 illustrates a distributed computing architecture, according to an example embodiment.

FIG. 9 illustrates an example distributed computing architecture 900, in accordance with an example embodiment. FIG. 9 shows server devices 902 and 904 configured to communicate, via network 906, with programmable devices 908*a*, 908*b*, and 908*c*. The network 906 may correspond to a LAN, a wide area network (WAN), a corporate intranet, the public Internet, or any other type of network configured to provide a communications path between networked computing devices. The network 906 may also correspond to a combination of one or more LANs, WANs, corporate intranets, and/or the public Internet.

Although FIG. 9 shows three programmable devices, distributed application architectures may serve tens, hundreds, thousands, or any other number of programmable devices. Moreover, the programmable devices 908*a*, 908*b*, and 908*c* (or any additional programmable devices) may be any sort of computing device, such as an ordinary laptop computer, desktop computer, network terminal, wireless communication device (e.g., a tablet, a cell phone or smart phone, a wearable computing device, etc.), and so on. In some examples, the programmable devices 908*a*, 908*b*, and 908*c* may be dedicated to the design and use of software applications. In other examples, the programmable devices 908*a*, 908*b*, and 908*c* may be general purpose computers that are configured to perform a number of tasks and may not be dedicated to software development tools. For example the programmable devices 908*a*-908*c* may be configured to provide speech processing functionality similar to that discussed in FIGS. 1-8. For example, the programmable devices 908*a-c* may include a device such as the device 800, or may include a system such as the systems 100, 200, or 400.

The server devices 902 and 904 can be configured to perform one or more services, as requested by programmable devices 908*a*, 908*b*, and/or 908*c*. For example, server device 902 and/or 904 can provide content to the programmable devices 908*a*-908*c*. The content may include, but is not limited to, web pages, hypertext, scripts, binary data such as compiled software, images, audio, and/or video. The content can include compressed and/or uncompressed content. The content can be encrypted and/or unencrypted. Other types of content are possible as well.

As another example, the server device 902 and/or 904 can provide the programmable devices 908*a*-908*c* with access to software for database, search, computation (e.g., vocoder speech synthesis), graphical, audio (e.g. speech content), video, World Wide Web/Internet utilization, and/or other functions. Many other examples of server devices are possible as well. In some examples, the server devices 902 and/or 904 may perform at least some of the functions described in FIGS. 1-8.

The server devices 902 and/or 904 can be cloud-based devices that store program logic and/or data of cloud-based applications and/or services. In some examples, the server devices 902 and/or 904 can be a single computing device residing in a single computing center. In other examples, the server devices 902 and/or 904 can include multiple computing devices in a single computing center, or multiple computing devices located in multiple computing centers in diverse geographic locations. For example, FIG. 9 depicts each of the server devices 902 and 904 residing in different physical locations.

In some examples, data and services at the server devices 902 and/or 904 can be encoded as computer readable information stored in non-transitory, tangible computer readable media (or computer readable storage media) and accessible by programmable devices 908*a*, 908*b*, and 908*c*, and/or other computing devices. In some examples, data at the server device 902 and/or 904 can be stored on a single disk drive or other tangible storage media, or can be implemented on multiple disk drives or other tangible storage media located at one or more diverse geographic locations.

Figure 10:
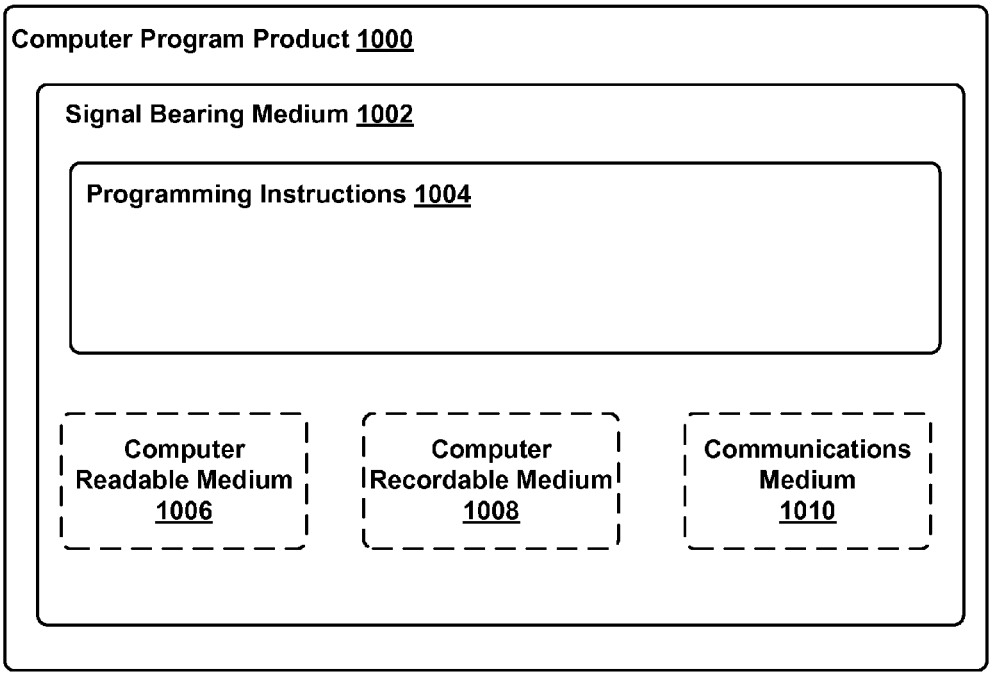
FIG. 10 depicts an example computer-readable medium configured according to at least some embodiments described herein.

FIG. 10 depicts an example computer-readable medium configured according to at least some embodiments described herein. In example embodiments, the example system can include one or more processors, one or more forms of memory, one or more input devices/interfaces, one or more output devices/interfaces, and machine readable instructions that when executed by the one or more processors cause the system to carry out the various functions tasks, capabilities, etc., described above.

As noted above, in some embodiments, the disclosed techniques (e.g. methods 300, 500, 600, and 700) can be implemented by computer program instructions encoded on a computer readable storage media in a machine-readable format, or on other media or articles of manufacture (e.g., the program instructions 810 of the device 800, or the instructions that operate the server devices 902-904 and/or the programmable devices 908*a*-908*c* in FIG. 9). FIG. 10 is a schematic illustrating a conceptual partial view of an example computer program product that includes a computer program for executing a computer process on a computing device, arranged according to at least some embodiments disclosed herein.

In one embodiment, the example computer program product 1000 is provided using a signal bearing medium 1002. The signal bearing medium 1002 may include one or more programming instructions 1004 that, when executed by one or more processors may provide functionality or portions of the functionality described above with respect to FIGS. 1-9. In some examples, the signal bearing medium 1002 can be a computer-readable medium 1006, such as, but not limited to, a hard disk drive, a Compact Disc (CD), a Digital Video Disk (DVD), a digital tape, memory, etc. In some implementations, the signal bearing medium 1002 can be a computer recordable medium 1008, such as, but not limited to, memory, read/write (R/W) CDs, R/W DVDs, etc. In some implementations, the signal bearing medium 1002 can be a communication medium 1010 (e.g., a fiber optic cable, a waveguide, a wired communications link, etc.). Thus, for example, the signal bearing medium 1002 can be conveyed by a wireless form of the communications medium 1010.

The one or more programming instructions 1004 can be, for example, computer executable and/or logic implemented instructions. In some examples, a computing device, such as the processor-equipped device 800 of FIG. 8 and/or programmable devices 908*a-c* of FIG. 9, may be configured to provide various operations, functions, or actions in response to the programming instructions 1004 conveyed to the computing device by one or more of the computer readable medium 1006, the computer recordable medium 1008, and/or the communications medium 1010. In other examples, the computing device can be an external device such as server devices 902-904 of FIG. 9 in communication with a device such as the device 800 and/or the programmable devices 908*a*-908*c*.

The computer readable medium 1006 can also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server. For example, the computer program product 1000 can implement the functionalities discussed in the description of FIGS. 1-9.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

receiving, by a device that includes one or more processors, an input indicative of acoustic feature parameters associated with speech;

identifying, using the input, a speech frame having an acoustic feature representation of the speech at a given time within a duration of the speech, wherein identifying the speech frame includes determining the acoustic feature parameters based on samples of the acoustic feature representation at harmonic frequencies associated with the speech frame;

based on the speech frame being a voiced speech frame, modifying aperiodicity parameters of the speech frame to correspond to: a first value for first harmonic frequencies greater than a first threshold, a second value for second harmonic frequencies less than a second threshold, and one or more values between the first value and the second value for given harmonic frequencies less than the first threshold and greater than the second threshold;

based on the modified aperiodicity parameters, determining a dispersion factor for phase parameters of the speech frame, wherein determining the dispersion factor includes modifying the phase parameters of the speech frame based on the determined dispersion factor;

determining, for a harmonic frequency of the speech, based on the acoustic feature parameters, the modified phase parameters and the modified aperiodicity parameters, a modulated noise representation for modulating noise pertaining to one or more of an aspirate or a fricative in the speech, wherein the aspirate is associated with a characteristic of an exhalation of at least a threshold amount of breath, and wherein the fricative is associated with a characteristic of airflow between two or more vocal tract articulators; and providing, by the device, an audio signal indicative of a synthetic audio pronunciation of the speech based on the modulated noise representation.

2. The method of claim 1, further comprising:

determining a representation of the speech that includes the acoustic feature parameters mapped to harmonic frequencies of the speech, wherein the representation includes modulated noise representations mapped also to the harmonic frequencies, and wherein the audio signal is based on the representation of the speech.

3. The method of claim 1, further comprising:

determining, based on the input, the acoustic feature parameters including spectral parameters associated with the speech, aperiodicity parameters associated with the speech, and phase parameters associated with the speech.

4. The method of claim 3, wherein the phase parameters are based on measured phase values indicated in the input and associated with one or more particular times within a duration of the speech.

5. The method of claim 3, further comprising:

receiving, by the device, a selection indicative of selected types of the acoustic feature parameters from one or more of Cepstrum, Mel-Cepstrum, Generalized-Mel-Cepstrum, Discrete Mel-Cepstrum, Log-Spectral, Auto-Regressive, Line-Spectrum-Pairs, Line-Spectrum-Frequencies, Mel-Line-Spectrum-Pairs, Reflection Coefficients, Log-Area-Ratio Coefficients, minimum-phase, maximum-phase, sum-of-cosines pulse, sum-of-sines pulse, constant random pulse, log-aperiodicity, filterbank-based quantization, or maximum voiced frequency, wherein determining the acoustic feature parameters is based on the selection.

6. The method of claim 1, wherein the given time corresponds to one or more of a time-instant associated with a characteristic of a glottal cycle of the speech or a given time-instant associated with an unvoiced portion of the speech.

7. The method of claim 6, further comprising:

determining, based on the input, a voiced glottal closure time-instant of the speech, wherein identifying the given speech frame is based on the given time corresponding to the voiced glottal closure time-instant, and wherein the voiced glottal closure time-instant is associated with a characteristic of a closure of at least a portion of a glottis for articulation of at least a portion of the speech.

8. The method of claim 6, further comprising:

determining, based on the input, an unvoiced time-instant of the speech, wherein identifying the given speech frame is based on the given time corresponding to the unvoiced time-instant.

9. The method of claim 1, further comprising:

based on the given speech frame being an unvoiced speech frame, modifying the acoustic feature parameters of the given speech frame for given harmonic frequencies less than a threshold; and modifying phase parameters of the given speech frame to correspond to random phase values, wherein determining the modulated noise representation is based on modifying the acoustic feature parameters and modifying the phase parameters.

10. The method of claim 1, wherein modifying the aperiodicity parameters includes monotonically increasing the one or more values associated with the given harmonic frequencies.

11. The method of claim 1, further comprising:

receiving a sequence of speech frames indicative of the speech, wherein a first speech frame includes a first acoustic feature representation of the speech at a first time within a duration of the speech, and wherein receiving the input includes receiving the sequence, and wherein the sequence is associated with a given time-period between adjacent speech frames of the sequence;

based on the first speech frame being a voiced speech frame, determining a pitch period of the first speech frame based on a pitch frequency indicated by the first acoustic feature representation;

based on the first speech frame being an unvoiced speech frame, providing a given pitch period as the pitch period of the first speech frame; and identifying, from within the sequence, a second speech frame associated with a second time within the duration, wherein the second time is based on a sum of the first time and the pitch period, and wherein determining the modulated noise representation is based on the first acoustic feature representation and a second acoustic feature representation of the second speech frame.

12. The method of claim 11, further comprising:

determining a plurality of synthetic audio sounds associated with portions of the speech, wherein a given synthetic audio sound has a given duration that corresponds to the given time-period between the adjacent speech frames in the sequence, and wherein providing the audio signal includes providing the plurality of synthetic audio sounds.

13. A non-transitory computer readable medium having stored therein instructions, that when executed by a computing device, cause the computing device to perform functions comprising:

receiving an input indicative of acoustic feature parameters associated with speech;

identifying, using the input, a speech frame having an acoustic feature representation of the speech at a given time within a duration of the speech, wherein identifying the speech frame includes determining the acoustic feature parameters based on samples of the acoustic feature representation at harmonic frequencies associated with the speech frame;

based on the speech frame being a voiced speech frame, modifying aperiodicity parameters of the speech frame to correspond to: a first value for first harmonic frequencies greater than a first threshold, a second value for second harmonic frequencies less than a second threshold, and one or more values between the first value and the second value for given harmonic frequencies less than the first threshold and greater than the second threshold;

based on the modified aperiodicity parameters, determining a dispersion factor for phase parameters of the speech frame, wherein determining the dispersion factor includes modifying the phase parameters of the speech frame based on the determined dispersion factor;

determining, for a harmonic frequency of the speech, based on the acoustic feature parameters, the modified phase parameters and the modified aperiodicity parameters, a modulated noise representation for modulating noise pertaining to one or more of an aspirate or a fricative in the speech, wherein the aspirate is associated with a characteristic of an exhalation of at least a threshold amount of breath, and wherein the fricative is associated with a characteristic of airflow between two or more vocal tract articulators; and providing an audio signal indicative of a synthetic audio pronunciation of the speech based on the modulated noise representation.

14. The non-transitory computer readable medium of claim 13, the functions further comprising:

determining a representation of the speech that includes the acoustic feature parameters mapped to harmonic frequencies of the speech, wherein the representation includes modulated noise representations mapped also to the harmonic frequencies, and wherein the audio signal is based on the representation of the speech.

15. The non-transitory computer readable medium of claim 13, the functions further comprising:

determining, based on the input, the acoustic feature parameters including spectral parameters associated with the speech, aperiodicity parameters associated with the speech, and phase parameters associated with the speech.

16. A device comprising:

one or more processors; and data storage configured to store instructions executable by the one or more processors to cause the device to:

receive an input indicative of acoustic feature parameters associated with speech;

identify, using the input, a speech frame having an acoustic feature representation of the speech at a given time within a duration of the speech, wherein identifying the speech frame includes determining the acoustic feature parameters based on samples of the acoustic feature representation at harmonic frequencies associated with the speech frame;

based on the speech frame being a voiced speech frame, modify aperiodicity parameters of the speech frame to correspond to: a first value for first harmonic frequencies greater than a first threshold, a second value for second harmonic frequencies less than a second threshold, and one or more values between the first value and the second value for given harmonic frequencies less than the first threshold and greater than the second threshold;

based on the modified aperiodicity parameters, determine a dispersion factor for phase parameters of the speech frame, wherein determining the dispersion factor includes modifying the phase parameters of the speech frame based on the determined dispersion factor;

determine, for a harmonic frequency of the speech, based on the acoustic feature parameters, the modified phase parameters and the modified aperiodicity parameters, a modulated noise representation for modulating noise pertaining to one or more of an aspirate or a fricative in the speech, wherein the aspirate is associated with a characteristic of an exhalation of at least a threshold amount of breath, and wherein the fricative is associated with a characteristic of airflow between two or more vocal tract articulators; and provide an audio signal indicative of a synthetic audio pronunciation of the speech based on the modulated noise representation.

17. The device of claim 16, wherein the instructions further cause the device to:

determine a representation of the speech that includes the acoustic feature parameters mapped to harmonic frequencies of the speech, wherein the representation includes modulated noise representations mapped also to the harmonic frequencies, and wherein the audio signal is based on the representation of the speech.

18. The device of claim 16, wherein the instructions further cause the device to:

determine, based on the input, the acoustic feature parameters including spectral parameters associated with the speech, aperiodicity parameters associated with the speech, and phase parameters associated with the speech.

* * * * *